US010481542B2

(12) United States Patent
Kobayashi

(10) Patent No.: US 10,481,542 B2
(45) Date of Patent: Nov. 19, 2019

(54) SHEET PROCESSING APPARATUS AND IMAGE FORMING APPARATUS

(71) Applicant: Misao Kobayashi, Kofu (JP)

(72) Inventor: Misao Kobayashi, Kofu (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 88 days.

(21) Appl. No.: 15/496,560

(22) Filed: Apr. 25, 2017

(65) Prior Publication Data

US 2017/0315492 A1 Nov. 2, 2017

(30) Foreign Application Priority Data

May 2, 2016 (JP) ..... 2016-092732
May 2, 2016 (JP) ..... 2016-092733
May 2, 2016 (JP) ..... 2016-092734

(51) Int. Cl.
*G03G 15/00* (2006.01)
*B65H 37/04* (2006.01)
*B31F 5/02* (2006.01)

(52) U.S. Cl.
CPC ..... *G03G 15/6541* (2013.01); *B65H 37/04* (2013.01); *B31F 5/02* (2013.01); *B65H 2301/43828* (2013.01); *B65H 2301/51616* (2013.01); *B65H 2801/27* (2013.01)

(58) Field of Classification Search
CPC ..... B65H 2301/51616; B65H 2301/43828; B31F 5/02
See application file for complete search history.

(56) References Cited

U.S. PATENT DOCUMENTS 4,898,372 A * 2/1990 Hirabayashi ..... G03G 15/6541 270/58.12
8,346,033 B2 * 1/2013 Kubota ..... H01L 25/167 385/14
2011/0011233 A1 * 1/2011 Baba ..... B26D 5/16 83/628
2015/0174941 A1 * 6/2015 Osada ..... B42C 9/0081 412/37
2015/0239587 A1 * 8/2015 Abe ..... G03G 15/6544 100/7

FOREIGN PATENT DOCUMENTS

JP 01257598 A * 10/1989
JP 2010-274623 A 12/2010
JP 2012-047940 A 3/2012
JP 2016-010968 A 1/2016

* cited by examiner

*Primary Examiner* — Jennifer E Simmons
(74) *Attorney, Agent, or Firm* — Manabu Kanesaka

(57) ABSTRACT

The present sheet processing apparatus comprises: a pressure tooth part that has a concave-convex surface and pressurizes the sheet bundle; a receiving tooth part that is disposed opposite to the pressure tooth part so as to receive pressurization from the pressure tooth part with the sheet bundle held therebetween; a moving part that reciprocates the pressure tooth part with respect to a receiving surface of the receiving tooth part; and a drive part that drives the moving part that moves the pressure tooth part for crimping of the sheet bundle. The pressure tooth part is divided in the direction crossing the pressurizing direction of the pressure tooth part into a plurality of pressure tooth parts, and the obtained pressure tooth parts are sequentially pressurized for crimping.

14 Claims, 15 Drawing Sheets

SHEET PROCESSING APPARATUS AND IMAGE FORMING APPARATUS

BACKGROUND OF THE INVENTION

Field of the Invention

The present invention relates to a sheet processing apparatus that binds sheets stacked in a bundle and, more particularly, to a sheet processing apparatus that crimps the sheets with pressure tooth members for binding and an image forming apparatus provided with the sheet processing apparatus.

Description of the Related Art

Conventionally, there are known image forming apparatuses, such as copier, a laser beam printer, a facsimile, and a multifunction machine obtained by combining them, provided with a sheet processing apparatus that applies processing such as binding to image-formed sheets. In such an image forming apparatus, when a sheet bundle is bound by the sheet processing apparatus, a metal staple is generally used to bind the sheet bundle.

However, it is necessary to remove the staple in order to loosen the bound sheet bundle, which is troublesome and likely to damage the sheets. To cope with this, there is proposed a staple-less binding mechanism. The staple-less binding mechanism pressurizes a sheet bundle by means of a press mechanism to deform the individual sheets such that they are mutually engaged with each other, thereby binding the sheet bundle. The thus crimping-bound sheet bundle can be easily loosed.

For example, JP2012-47940A discloses a mechanism that stacks sheets fed from an image forming apparatus in a bundle and crimps the sheets with a pair of upper and lower pressure tooth members for binding. This mechanism drives a fixed-side pressure tooth member having a concavo-convex surface and a movable-side pressure tooth member having a concavo-convex surface engaged with the concavo-convex surface of the fixed-side pressure tooth member by means of a motion transmission mechanism such as a cam connected to the drive motor for the pressure tooth members.

Further, JP2010-274623A discloses a mechanism that presses a swingably axially supported pressure lever (upper tooth form member 60 A in this document) against a fixed member (lower tooth form member) by means of a drive cam connected to a drive motor (stepping motor). In this mechanism, the sheet bundle is pressed with about 100 kgf.

Thus, in the crimp-binding, large force is required to make the upper and lower tooth members mesh with each other, and in this case, it is necessary to increase strength of a member supporting the upper and lower tooth members to make the crimping mechanism robust. Further, it is necessary to increase the power of a drive source, etc., for the meshing, and this inevitably increases in cost.

To cope with this, JP2016-10968A discloses a mechanism obliquely mounted with respect to the turning axis of an arm supporting upper and lower tooth members and making the upper and lower tooth members gradually mesh with each other. In this mechanism, a sheet bundle is bound while being gradually deformed along the turning center of the support part, so that upon start of meshing of the upper and lower tooth members with the sheet bundle held therebetween, as illustrated in FIG. 13A of JP2016-10968A, pressurization starts from the start end side, thus making it possible to reduce the maximum load required.

SUMMARY OF THE INVENTION

However, in the crimp-binding device of JP2016-10968A, large force is required when the upper and lower tooth members mesh with each other as a whole and, further, when a deviation in the meshing position between them occurs, the start side ends thereof may collide with each other to make binding insufficient at the terminal end side of the sheet bundle.

Further, in this crimp-binding device of JP2016-10968A, when the upper tooth members are rotationally moved and pressed with respect to the lower tooth members, they are driven by a cam and a drive motor through the arm. In this case, it is necessary to dispose the cam and drive motor outside the arm rotation range, which restricts miniaturization of the device.

An object of the present invention is to provide a small-sized and low-cost sheet processing apparatus by dividing a pressure side pressure tooth member into a plurality of pressure tooth members to significantly reduce a load per unit area.

Another object of the present invention is to provide a sheet processing apparatus in which a concavo-convex surface of a pressure tooth member and that of a receiving tooth member can mesh with each other with high accuracy and the drive part for the tooth members are disposed compactly in the apparatus.

Disclosed is a sheet processing apparatus that crimp-binds a sheet bundle by pressurizing the sheet bundle from its front and back sides, including: a pressure tooth part that has a concave-convex surface and pressurizes the sheet bundle; a receiving tooth part that is disposed opposite to the pressure tooth part so as to receive pressurization from the pressure tooth part with the sheet bundle held therebetween; a moving part that reciprocates the pressure tooth part with respect to a receiving surface of the receiving tooth part; and a drive part that drives the moving part that moves the pressure tooth part for crimping of the sheet bundle. The pressure tooth part is divided in the direction crossing the pressurizing direction of the pressure tooth part into a plurality of pressure tooth parts, and the obtained pressure tooth parts are sequentially pressurized for crimping.

Further, to attain another object, there is provided a sheet processing apparatus that crimp-binds a sheet bundle by pressurizing the sheet bundle from its front and back sides, including: a pressure tooth part that has a concave-convex shape and is moved from one side of the sheet bundle to pressurize the sheet bundle; a receiving tooth part that has a concave-convex part and is disposed opposite to the pressure tooth part so as to receive pressurization from the pressure tooth part with the sheet bundle held therebetween; a moving part that reciprocates the pressure tooth part in the direction crossing a receiving surface of the receiving tooth part; and a drive part that drives the moving part such that the pressure tooth part is moved between a crimping position where it crimps the sheet bundle and a separating position separated from the crimping position. The pressure tooth part, receiving tooth part, and drive part are disposed along the moving direction of the moving part, and the moving part is disposed at the side of the drive part.

According to the present invention, there can be provided a sheet processing apparatus and an image forming apparatus which are small in size and low in cost.

BRIEF DESCRIPTION OF THE DRAWINGS

FIGS. 9A and 9B are perspective views each illustrating a drive mechanism of the crimp-binding unit, in which FIG. 9A is a perspective view of a drive system, and FIG. 9B is an exploded perspective view of a cylindrical cam;

DESCRIPTION OF THE PREFERRED EMBODIMENTS

A preferred embodiment of the present invention will be described below with reference to the drawings.

Figure 1:
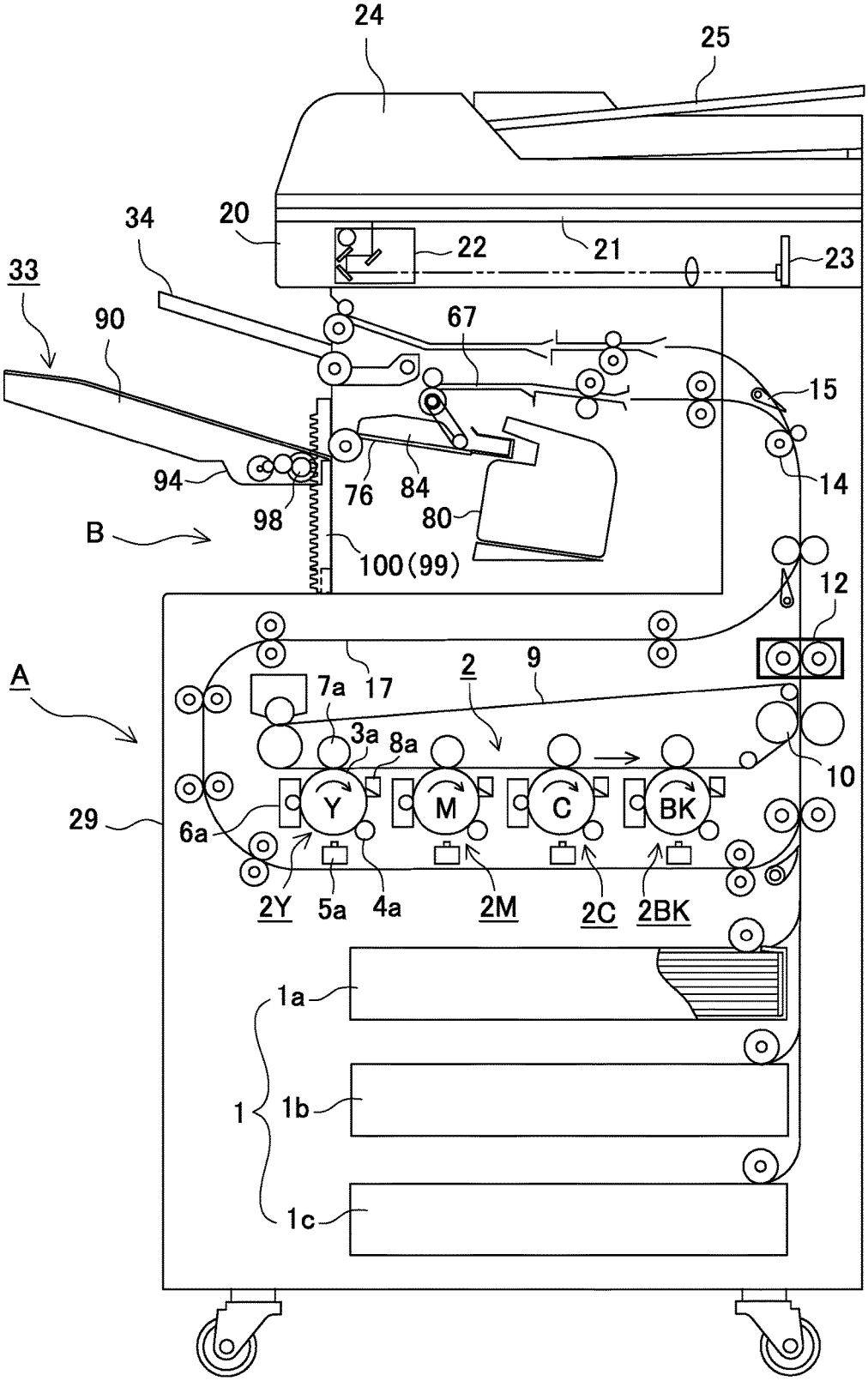
FIG. 1 is a configuration view of an image forming apparatus provided with a sheet processing apparatus according to an embodiment of the present invention.

FIG. 1 is an entire configuration view schematically illustrating an image forming apparatus. The image forming apparatus is constituted of an image forming system A and a sheet processing apparatus B according to the present invention.

[Image Forming System A]

The image forming system A illustrated in FIG. 1 includes an electrophotographic image forming section 2, a sheet feed section 1, and an image reading device 20. The sheet feed section 1 is positioned below the image forming section 2 and includes three vertically-arranged sheet feed cassettes 1*a*, 1*b*, and 1*c* each accommodating sheets. The image reading device 20 is positioned above a space above the image forming section 2 which is used as a sheet discharge space of the image forming system A when the sheet processing apparatus B is not attached. Thus, when being attached with the sheet processing apparatus B, the image forming system A is so-called an in-body type system that uses the sheet discharge space as illustrated.

The image forming section 2 adopts a tandem system using an intermediate transfer belt and thus uses four color components (yellow 2Y, magenta 2M, cyan 2C, and black 2BK). For example, for the yellow 2Y, a photosensitive drum 3*a* as an image carrier, a charger 4*a* having a charging roller that charges the photosensitive drum 3*a*, and an exposing device 5*a* that forms a latent image from an image signal read by the image reading device 20 are provided.

Further, for the yellow 2Y, a developing device 6*a* that forms a toner image from the latent image formed on the photosensitive drum 3*a* and a primary transfer roller 7*a* that primarily transfers the image on the photosensitive drum 3*a* formed by the developing device 6*a* onto an intermediate transfer belt 9 are provided. With this configuration, the image is primarily transferred onto the intermediate transfer belt 9 for each color component. The color component remaining on the photosensitive drum 3*a* is removed by a photosensitive cleaner 8*a* and prepared for the next image forming. The same configuration is applied for other color components.

The toner image on the intermediate transfer belt 9 is transferred by a secondary transfer roller 10 onto a sheet fed from the sheet feed section 1 and then melt-fixed onto the sheet through pressurization and heating using a fixing device 12. The color components superimposed on one another remaining on the intermediate transfer belt 9 are removed by an intermediate belt cleaner and prepared for the next image transfer.

The thus image-formed sheet is discharged to the sheet processing apparatus B by a discharge roller 14. When image formation is performed on both sides of a sheet, the sheet once conveyed to the sheet processing apparatus B side is switched back by a switching gate 15 to a circulation path 17, along which the sheet is fed once again to the image forming section 2, where image formation is performed on the back side of the sheet. The sheet whose one side or both sides are subjected to image formation is conveyed to the sheet processing apparatus B through the discharge roller 14.

The image reading device 20 is disposed above the sheet discharge space provided above the image forming section 2. In the image reading device 20, a document placed on a document stacker 25 is fed to a platen 21 by a document feeder 24. Then, the document is irradiated with light from a scan unit 22 to be read by a photoelectric conversion element (e.g., CCD), and the read image is stored in an unillustrated data storage section. When the stored image needs to be formed on the sheet by the image forming section, the operation as described above is performed.

[Sheet Processing Apparatus]

Figure 2:
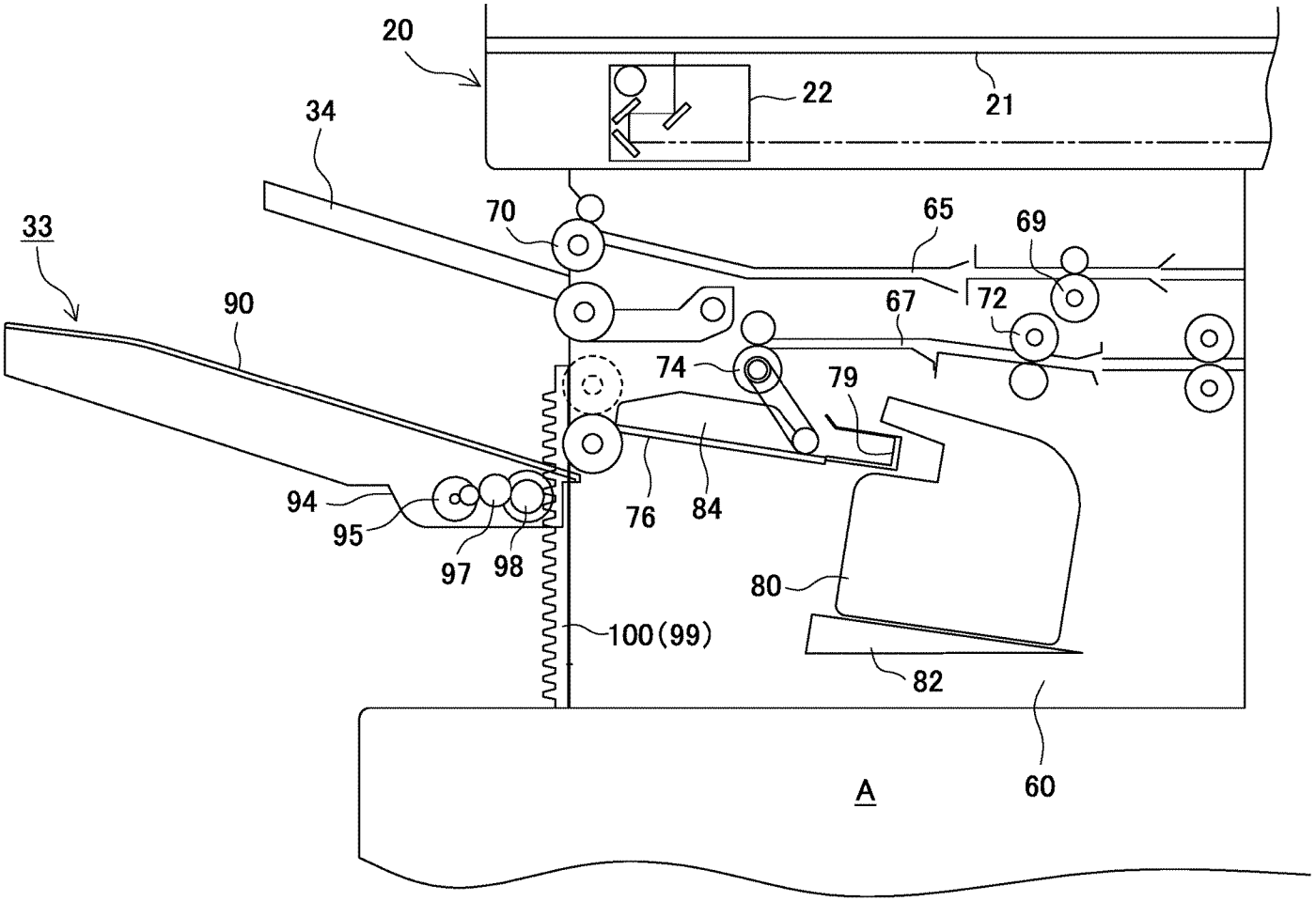
FIG. 2 is an enlarge view of a part corresponding to a processing tray of FIG. 1.

The sheet processing apparatus B is disposed in the sheet discharge space which is provided above the image forming section 2 and below the image reading device 20. As illustrated in FIG. 2, the sheet processing apparatus B includes a switchback path 65, a sheet discharge path 67, a processing tray 76, a sheet binding device 80, and a tray unit 33. The sheet discharge path 67 conveys image-formed sheets sequentially fed from the image forming section 2 for sheet binding. The processing tray 76 is the tray on which sheets from the sheet discharge path 67 are temporarily placed. The sheet binding device 80 binds a sheet bundle ST (see FIG. 3) placed on the processing tray 76. The tray unit 33 has a stacker tray 90 that stacks thereon the sheet bundle ST bound by the sheet binding device 80 or sheets discharged thereonto without being bound and is configured to move up and down. The following describes details of the above components.

[Switchback Path]

The switchback path 65 has a conveying roller 69 and a discharge roller 70 on the entrance and exit sides thereof, respectively, and functions as the path for switching back a sheet when the image forming section 2 forms an image on the back side of the sheet as well. A sheet not suitable for double side printing or binding processing by the sheet binding device 80, such as a thick paper, on the switchback path 65 is discharged to an escape tray 34 positioned above the tray unit 33 by the discharge roller 70.

[Tray Unit]

The tray unit 33 has a stacker tray 90 that stacks thereon the sheet bundle ST bound by the sheet binding device 80 or sheets discharged thereonto without being bound and is configured to move up and down. The stacker tray 90 moves up and down in such a way that an elevating pinion 98 therefor is engaged with an elevating rack 100 constituting a part of an elevating rail 99 as a moving rail to be rotated. The elevating pinion 98 is driven by an elevating motor 95 disposed in an elevating motor installation part 94 provided at the lower portion of the stacker tray 90 through a transmission gear 97 and the like.

[Sheet Discharge Path]

The sheet discharge path 67 is formed linearly in substantially the horizontal direction. On the entrance side of the sheet discharge path 67, a carry-in roller pair is disposed to make the sheet discharge path 67 communicate with a sheet carry-out port of the image forming section 2, while on the exit side, a discharge roller pair 74 is disposed. The carry-in roller pair 72 and sheet discharge roller pair 74 are motor-driven to convey a sheet.

[Processing Tray]

The processing tray 76 is provided with a regulating stopper 79 that regulates the position of a rear end part of a sheet in a sheet discharge direction (right-to-left direction in FIG. 2). A sheet discharged from the sheet discharge path 67 is reversely conveyed (that is, conveyed in the direction (to the right in FIG. 2) opposite to the direction in which the sheet is discharged from the sheet discharge path 67) to the processing tray 76. At this time, the front end of the sheet is regulated by the regulating stopper 79.

Figure 3:
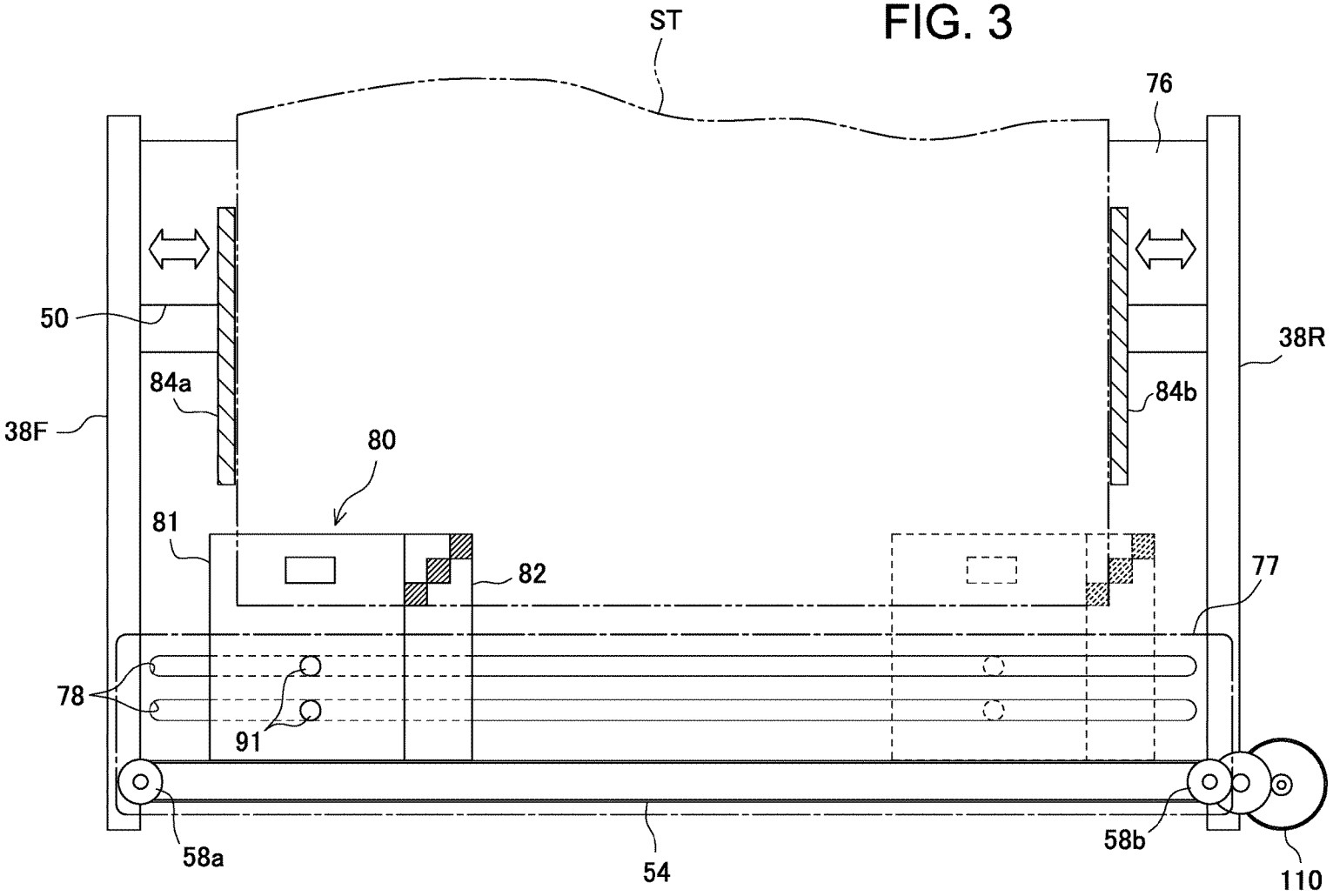
FIG. 3 is a plan view schematically illustrating an arrangement of a staple-binding unit and a crimp-binding unit which are integrated with each other on a processing tray.

FIG. 3 is a plan view illustrating the processing tray 76. The processing tray 76 is defined by a front-side frame 38F and a rear-side frame 38R. The front side is the side that faces a user of the image forming apparatus. In FIG. 3, the reversely conveyed sheet is conveyed toward the sheet binding device 80 from above, and the processing tray 76 is provided with an aligning device 84 for positioning of the conveyed sheet. The aligning device 84 is configured to move forward and backward in the direction crossing the conveying direction of the reversely conveyed sheet and constituted of a pair of aligning plates 84*a* and 84*b* which are positioned on the front and rear sides, respectively.

The aligning plates 84*a* and 84*b* are each fitted to and supported by a guide groove 50 which is formed on a sheet support surface of the processing tray 76 so as to extend in the direction crossing the sheet conveying direction and each configured to be slidable along the guide groove 50. Although not illustrated, the aligning plates 84*a* and 84*b* are moved while being held by a belt stretched between pulleys which are driven by front-side and rear-side aligning motors, respectively.

[Sheet Binding Device]

The sheet binding device 80 includes a staple-binding unit 81 and a crimp-binding unit 82 which are integrally arranged side by side and is disposed on the processing tray 76, as illustrated in FIG. 3. The sheet binding device is installed so as to reciprocate in the left-right direction on a unit moving table 77 disposed on the front end side of the processing tray 76. Further, a pair of projections 91 are provided at the lower portion of the sheet binding device 80 so as to fit to and slide along a pair of upper and down grooves 78, respectively, which are formed in the unit moving table 77 so as to extend from the front side to the rear side. The frames 38F and 38R have a pair of left and right pulleys 58*a* and 58*b*, respectively, and a timing belt 54 (toothed belt) is stretched between the pulleys 58*a* and 58*b*. The pulley 58*a* is connected to a binding unit moving motor 110.

[Staple-Binding Unit]

Figure 4:
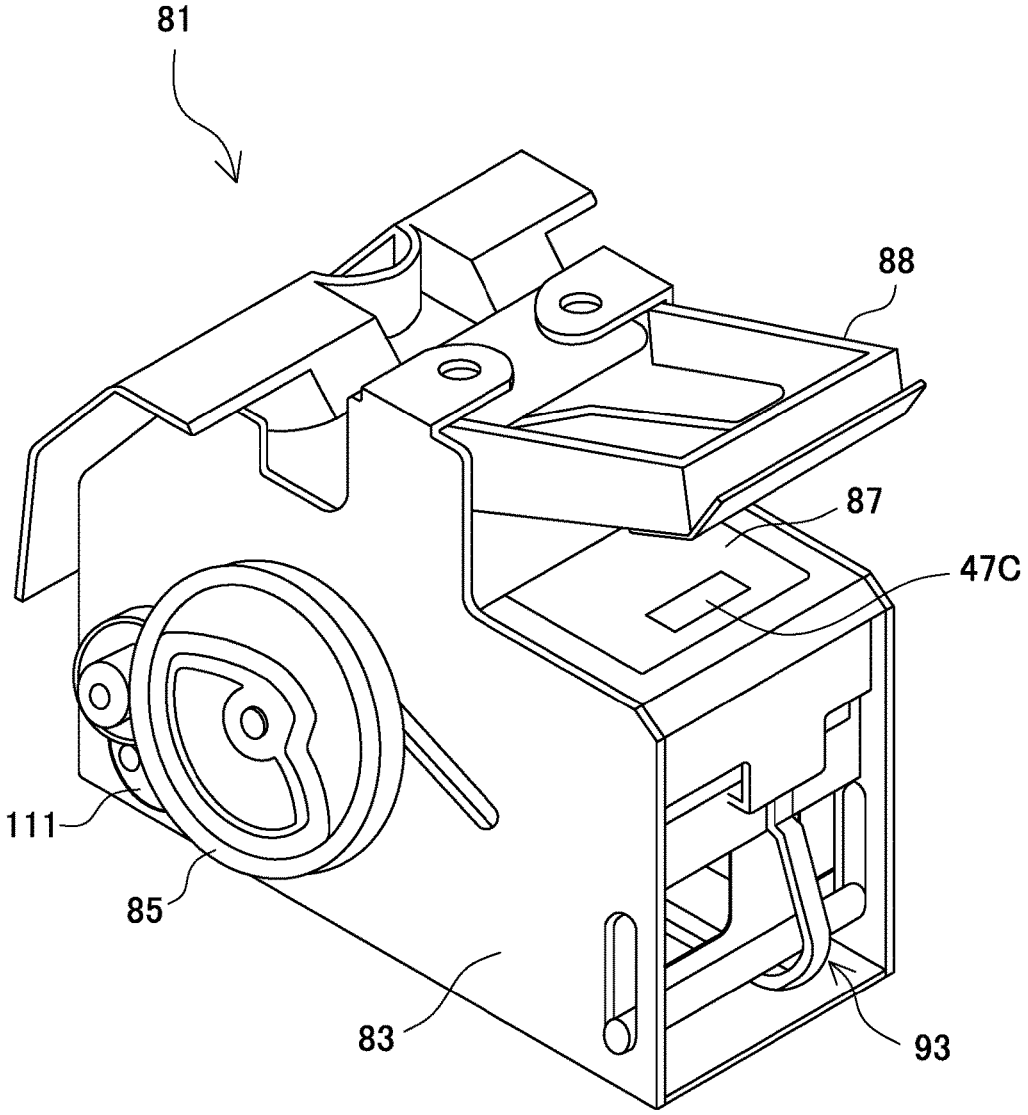
FIG. 4 is a view schematically illustrating the staple-binding unit.

There are known various types of staple-binding units as a device that performs binding processing by means of a staple or staples. For example, in the staple-binding unit illustrated in FIG. 4, a staple-binding motor 111 is accommodated in a unit frame 83 forming the contour of the unit 81, and a drive cam 85 to be driven into rotation by the staple-binding motor 111 is disposed on a side surface of the unit frame 83. Further, at the lower portion of the unit frame 83, a driving mechanism part 93 is formed. The driving mechanism part 93 is driven by the drive cam 85 to drive a U-shaped staple toward a sheet bundle ST on the processing tray 76. Further, on the upper surface of the unit frame 83, a table 87 on which a binding part of the sheet bundle ST on the processing tray 76 is placed is formed. A staple is driven by the driving mechanism part 93 upward toward the sheet bundle ST disposed on the table 87 from the lower surface side of the table 87.

At the upper portion of the unit frame 83, a clincher mechanism part 88 is formed. The clincher mechanism part 88 bends the staple legs having been driven by the driving mechanism part 93 and penetrating through the sheet bundle ST disposed on the table 87 to protrude from the upper surface of the sheet bundle ST along the upper surface thereof. The clincher mechanism part 88 is pivotally mounted with respect to the unit frame 83 at the rear end portion thereof and is pivoted so as to hold a sheet bundle ST between the upper surface of the table 87 and clincher mechanism part 88 after the sheet bundle ST is disposed on the table 87.

Further, the clincher mechanism part 88 has a cutter unit (not illustrated) that cuts the leading end portions of the respective staple legs so as to make the length of a part of each staple leg that protrudes from the upper surface of the sheet bundle ST constant. After cutting the staple legs, the clincher mechanism part 88 bends the staple legs along the upper surface of the sheet bundle ST to staple-bind the sheet bundle ST.

[Crimp-Binding Unit]

The following describes the crimp-binding unit 82 directly relating to the present invention.

Figure 5:
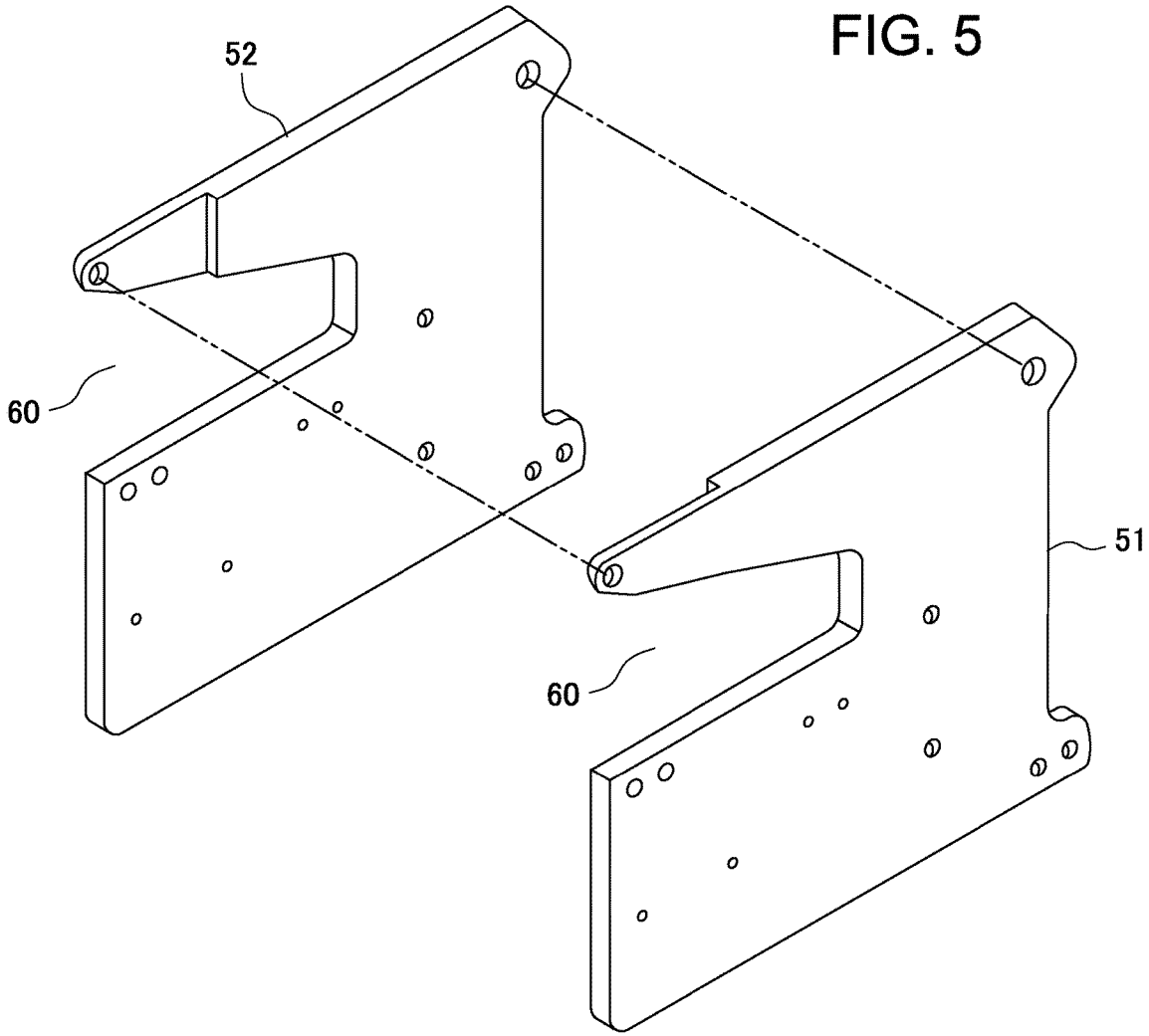
FIG. 5 is an explanatory view of a front plate and a base plate constituting the crimp-binding unit.
Figure 6:
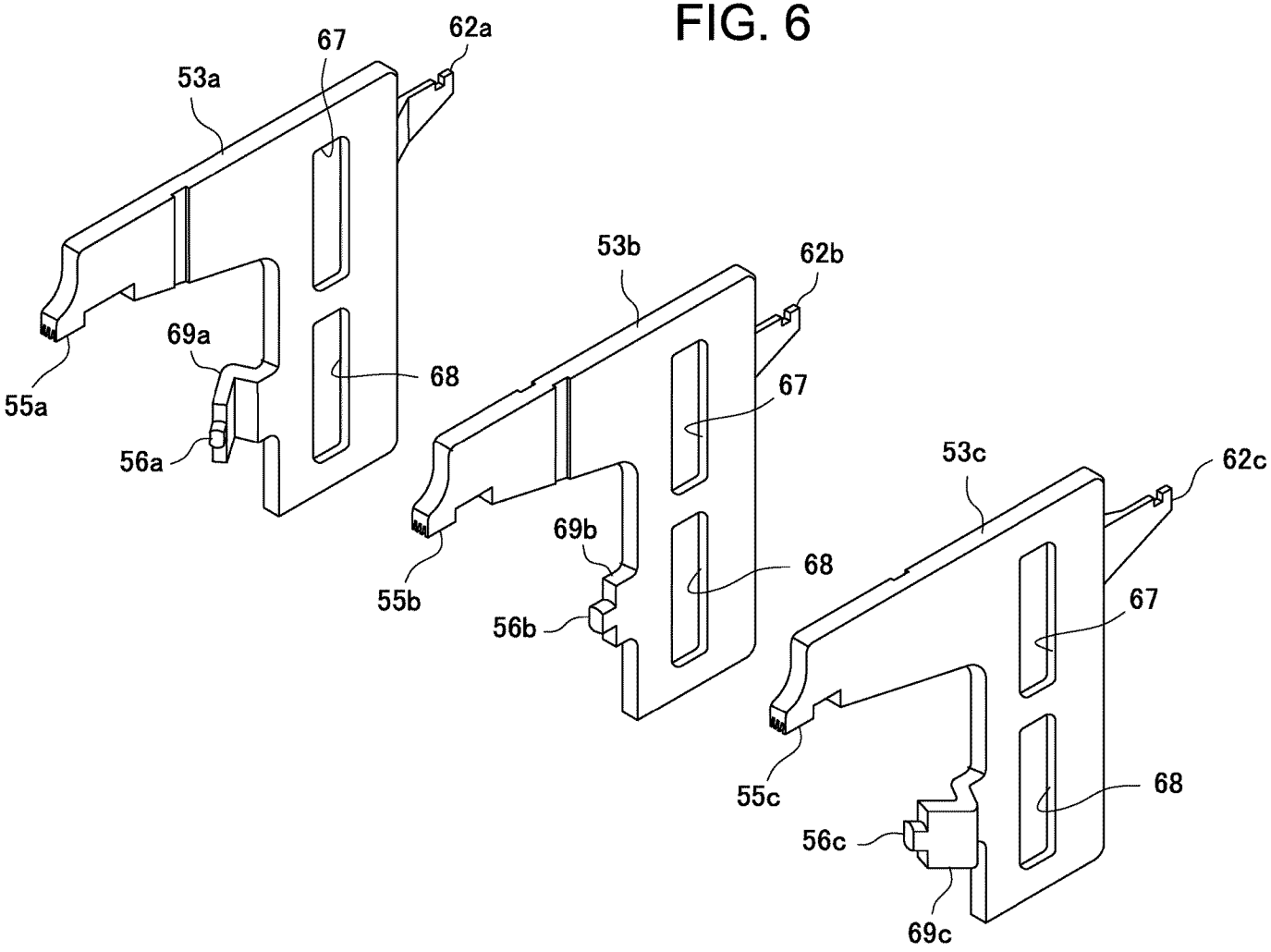
FIG. 6 is a perspective view of a base plate side pressure plate, a center pressure plate, and a front plate side pressure plate which are arranged between the front plate and the base plate.

The crimp-binding unit 82 performs crimp-binding by pressurizing a sheet bundle ST from its front and back sides and, as illustrated in FIG. 5, includes a front plate 51 and a base plate 52 having notches 60 of the same shape in their respective surfaces parallel to the direction in which a sheet bundle ST is conveyed to the processing tray 76. The notch 60 forms a placing part 31 which is the space on which a sheet bundle ST to be subject to crimp-binding is placed. Further, as illustrated in FIG. 6, three pressure plates 53*a*, 53*b*, and 53*c* are arranged between the front plate 51 and the base plate 52 with their surfaces parallel to the direction in which a sheet bundle ST is conveyed to the processing tray 76 overlapping each other.

The pressure plates 53*a*, 53*b*, and 53*c* have pressure tooth parts 55*a*, 55*b*, and 55*c*, respectively, and are biased by rotation of a cam for movement. In the present embodiment, a cylindrical cam 40 is used as the above cam. The pressure plates 53*a*, 53*b*, and 53*c* each have a pair of upper and lower elongated holes 67 and 68 elongated in the vertical direction, have pressure tooth parts 55*a*, 55*b*, and 55*c*, respectively, each having a concavo-convex surface for crimp-binding sheets, and have cam follower pins 56*a*, 56*b*, and 56*c*, respectively, each engaged with a cam groove 41 formed on the peripheral surface of the cylindrical cam 40. The elongated holes 67 formed in the respective pressure plates 53*a*, 53*b*, and 53*c* have the same shape such that when the pressure plates 53*a*, 53*b*, and 53*c* are arranged between the front plate 51 and the base plate 52, the elongated holes 67 completely overlap each other as viewed in a side surface direction (a direction crossing the sheet conveying direction). Similarly, the elongated holes 68 formed in the respective pressure plates 53*a*, 53*b*, and 53*c* have the same shape. The pressure tooth parts 55*a*, 55*b*, and 55*c* are provided at base end portions protruding from the base end sides of the respective pressure plates 53*a*, 53*b*, and 53*c*, and the base end portions and pressure tooth parts 55*a*, 55*b*, and 55*c* are formed into a sickle shape in the pressure plates 53*a*, 53*b*, and 53*c*, respectively.

Figure 7A:
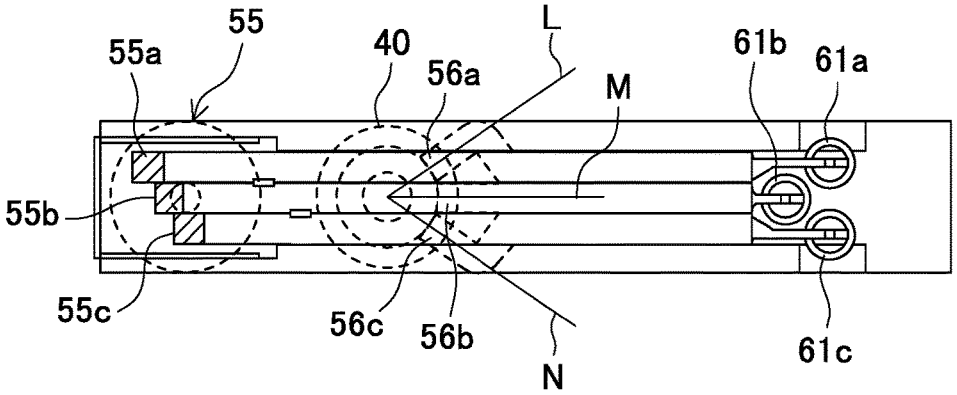
FIGS. 7A and 7B are a plan view and a side view of the crimp-binding unit, respectively.
Figure 7B:
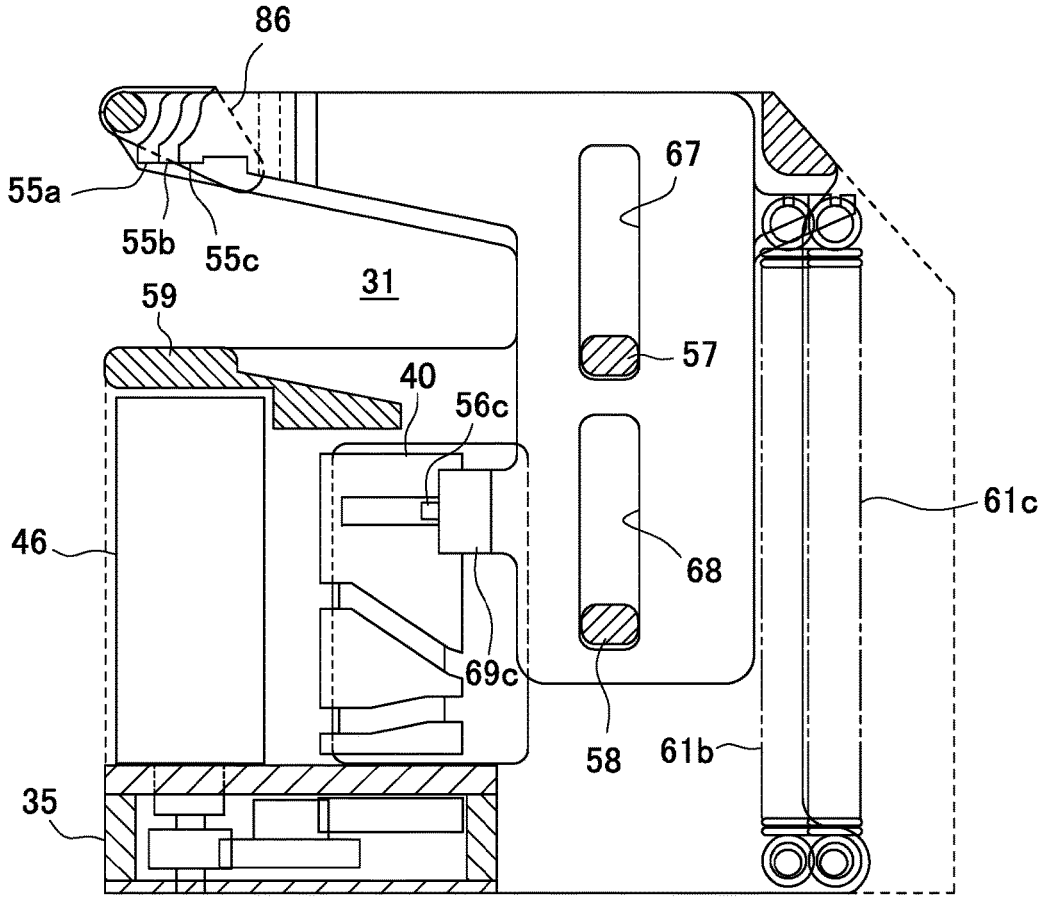

FIGS. 7A and 7B are a plan view and a side view of the crimp-binding unit 82, respectively. The pressure tooth parts 55*a*, 55*b*, and 55*c* (reference numeral 55 is used, when collectively referred to) have the same shape as viewed from the side surface direction; however, distances from the base end portions of the respective pressure plates 53*a*, 53*b*, and 53*c* and pressure tooth parts 55*a*, 55*b*, and 55*c* are different, so that when viewed from the above, the pressure tooth parts 55*a*, 55*b*, and 55*c* are arranged stepwise. Thus, as illustrated in FIG. 3, crimping parts are formed stepwise in a sheet bundle ST by the pressure tooth parts 55*a*, 55*b*, and 55*c* of the crimp-binding unit 82. As described above, in the present embodiment, the pressure tooth part 55 that crimp-binds a sheet bundle ST is constituted by the pressure tooth parts 55*a*, 55*b*, and 55*c* formed in the three respective pressure plates 53*a*, 53*b*, and 53*c*.

The cam follower pins 56*a*, 56*b*, and 56*c* are provided at the same height position from the bottom surfaces of the respective pressure plates 53*a*, 53*b*, and 53*c*. The cam follower pins 56*a*, 56*b*, and 56*c* are provided in the respective pressure plates 53*a*, 53*b*, and 53*c* such that axial lines L, M, and N thereof are the normal lines to the curved surface of the cylindrical cam 40. In this case, when the crimp-binding unit 82 is assembled with the pressure plates 53*a*, 53*b*, and 53*c* arranged between the front plate 51 and the base plate 52, the center pressure plate 53*b* directly faces the peripheral surface of the cylindrical cam 40, so that a follower pin support part 69*b* having the cam follower pin 56*b* is formed so as to protrude horizontally from the pressure plate 53*b* in parallel thereto.

On the other hand, the pressure plates 53*a* and 53*c* face the peripheral surface of the cylindrical cam 40 in directions deviated leftward and rightward, respectively. Accordingly, a follower pin support part 69*a* having the cam follower pin 56*a* of the pressure plate 53*a* is formed in a protruding manner so as to be bent leftward, and a follower pin support part 69*c* having the cam follower pin 56*c* of the pressure plate 53*c* is formed in a protruding manner so as to be bent rightward. As a result, the cam follower pins 56*a* and 55*c* can be engaged reliably with the cam groove 41 like the cam follower pin 55*b*.

Figure 8:
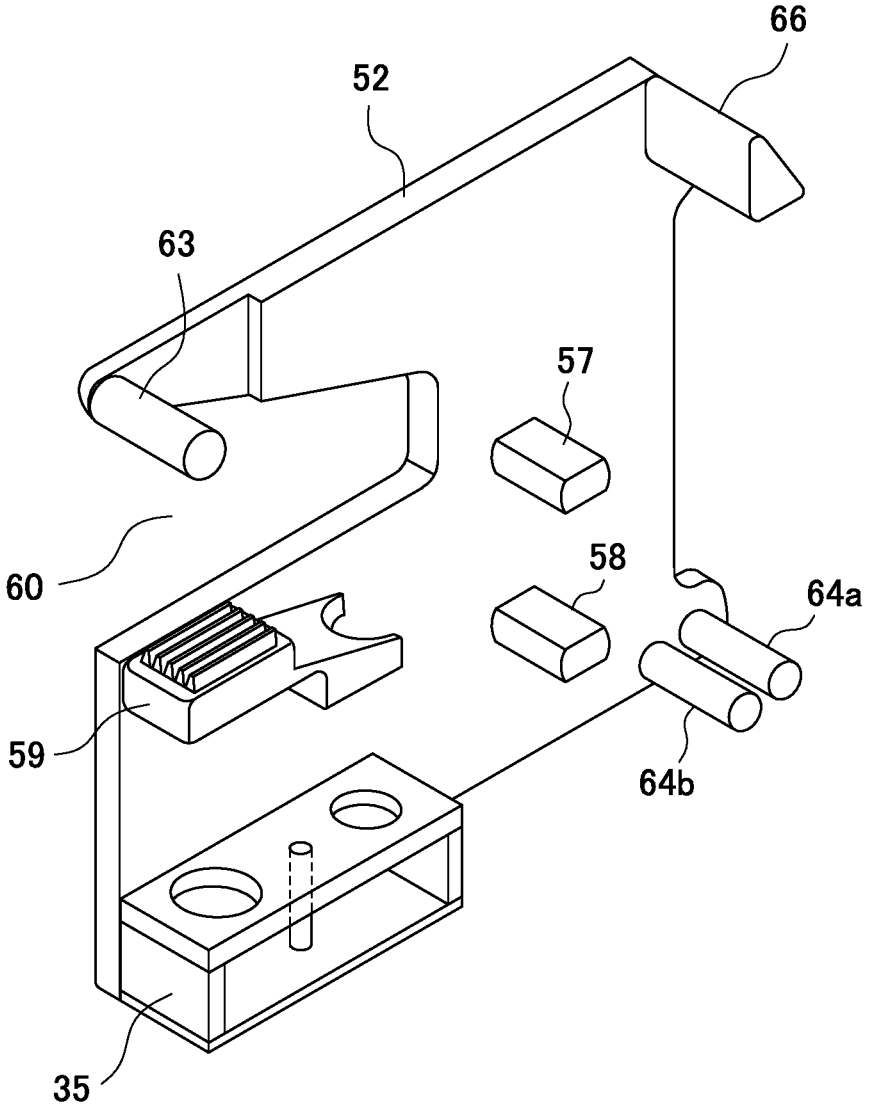
FIG. 8 is a perspective view illustrating the base plate, excluding a drive system.

As illustrated in FIG. 8, the base plate 52 has slide guides 57 and 58, a receiving tooth part 59 having a concavo-convex surface that receives a pressure applied by the pressure tooth parts 55*a*, 55*b*, and 55*c*, and a crimp-binding part base 35. The slide guides 57 and 58 penetrate through the elongated holes 67 and 68 of the respective pressure plates 53*a*, 53*b*, and 53*c* and are moved (relatively) in the elongated holes 67 and 68, respectively. The base plate 52 further has connection pins 63, 64*a*, and 64*b* and a connection part 66 which abut against the surface of the front plate 51 that faces the base plate 52 when the base plate 52 and front plate 51 are assembled with each other with the pressure plates 53*a*, 53*b*, and 53*c* interposed therebetween.

The slide guides 57 and 58, receiving tooth part 59, crimp-binding part base 35, connection pins 63, 64*a*, and 64*b*, and connection part 66 have the same dimension in the direction toward the front plate 51 and, when the crimp-binding unit 82 is assembled, the pressure plates 53*a*, 53*b*, and 53*c* are arranged within this dimension and vertically movable in a space between the front plate 51 and base plate 52. Thus, the space between the front plate 51 and the base plate 52 serves as a slide guide part where the pressure plates 53*a*, 53*b*, and 53*c* are vertically movable.

The receiving tooth part 59 is disposed opposite to the pressure tooth parts 55*a*, 55*b* and, when the pressure plates 53*a*, 53*b*, and 53*c* are slid in the slide guide part, the pressure tooth parts 55*a*, 55*b*, and 55*c* are vertically moved with respect to the receiving tooth part 59 between a crimping position and a separating position. The receiving tooth part 59 has the concavo-convex surface fitted to and receiving the concavo-convex surfaces of the respective pressure tooth parts 55*a*, 55*b*, and 55*c*.

The dimension of the receiving tooth part 59 is set such that the range that the receiving tooth part 59 receives the pressure applied by the pressure tooth parts 55*a*, 55*b*, and 55*c* is at least as large as the pressurizing range of the pressure tooth part 55 (pressure tooth parts 55*a*, 55*b*, and 55*c*). In the present embodiment, there are provided the three pressure tooth parts 55*a*, 55*b*, and 55*c*, so that the pressurizing range of each of the pressure tooth parts 55*a*, 55*b*, and 55*c* is set to about ⅓ of the width and length of the receiving tooth part 59. Thus, when the number of the pressure tooth parts is two, the pressurizing range of each pressure tooth part is set to about ½ of the width and length of the receiving tooth part 59. Further, when the number of the pressure tooth parts is four, the pressurizing range of each pressure tooth part is set to about ¼ of the width and length of the receiving tooth part 59.

Figure 9B:
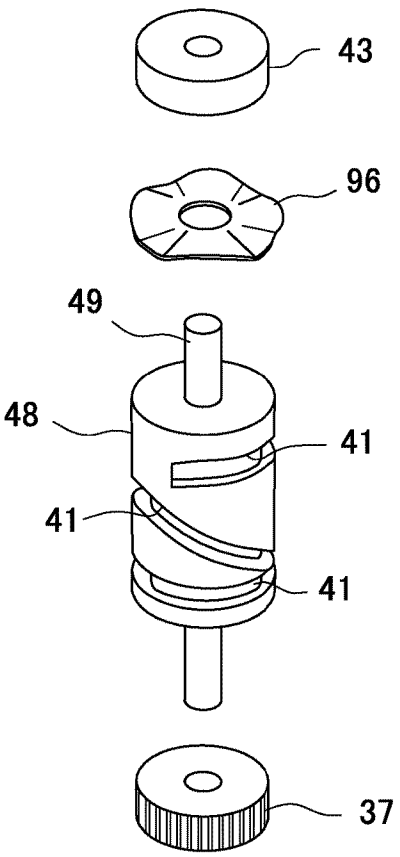
Figure 9A:
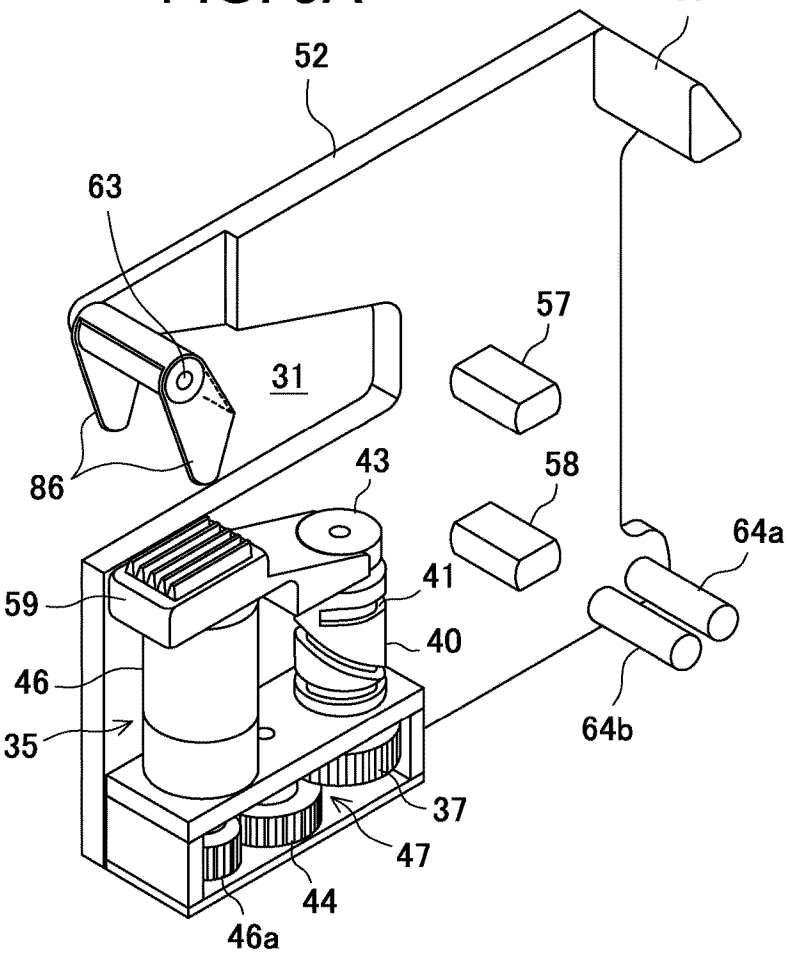

The crimp-binding part base 35 is disposed at sides of the pressure plates 53*a*, 53*b*, and 53*c* and is mounted with a crimp-binding motor 46, a deceleration gear 47, and the cylindrical cam 40, as illustrated in FIGS. 9A and 9B. In this case, the crimp-binding motor 46 and cylindrical cam which are placed on the upper surface of the crimp-binding part base 35 are incorporated in a space between the crimp-binding part base 35 and the receiving tooth part 59 with their upper surfaces supported by the lower surface of the receiving tooth part 59.

As illustrated in FIG. 9B, the cylindrical cam 40 is rotatably supported by a vertically installed rotary shaft 49 through a wave washer 96 and has a helical cam groove 41 in its outer peripheral surface. The rotary shaft 49 is supported at its upper end by a bearing 43 fixedly mounted to the base plate 52 and connected at its lower end with a gear 37 meshing with a gear of the deceleration gear 47. A gear 44 positioned at an end portion of the deceleration gear 47 is directly connected to a gear 46*a* connected to a drive shaft of the crimp-binding motor 46.

The pressure plates 53*a*, 53*b*, and 53*c* have engagement parts 62*a*, 62*b*, and 62*c* with which the upper ends of the pressure springs 61*a*, 61*b*, and 61*c* as tension springs are engaged at their side edge upper portions on the opposite side to the side edge at which the pressure tooth parts 55*a*, 55*b*, and 55*c* are formed. The pressure springs 61*a*, 61*b*, and 61*c* are elastic members that bias the respective pressure tooth parts 55*a*, 55*b*, and 55*c* toward the receiving tooth part 59. The engagement part 62*b* of the center pressure plate 53*b* is disposed at a position deviated from the engagement parts 62*a* and 62*c* of the pressure plates 53*a* and 53*c* in the horizontal direction. This is for preventing the pressure springs 61*a*, 61*b*, and 61*c* from contacting one another in a state where the pressure plates 53*a*, 53*b*, and 53*c* are set between the front plate 51 and the base plate 52. Thus, the lower ends of the pressure springs 61*a* and 61*c* are fixed to the connection pin 64*a*, while the lower end of the pressure spring 61*b* is fixed to the connection pin 64*b* positioned inward of the connection pin 64*a* in the horizontal direction.

As described above, the pressure plates 53*a*, 53*b*, and 53*c* are vertically movable in the space between the front plate 51 and the base plate 52. In the initial state, the cam follower pins 56*a*, 56*b*, and 56*c* at home positions of the pressure plates 53*a*, 53*b*, and 53*c* are engaged with the cam groove 41 at the highest position, so that, as illustrated in FIG. 7B, the upper sides of the pressure plates 53*a*, 53*b*, and 53*c* are held at the height position corresponding to the upper sides of the front plate 51 and base plate 52 against tensile forces of the pressure springs 61*a*, 61*b*, and 61*c*. In this initial state, the slide guides 57 and 58 of the base plate 52 are positioned at the lower ends of the elongated holes 67 and 68 of each of the pressure plates 53*a*, 53*b*, and 53*c*.

Downward movements of the cam follower pins 56*a*, 56*b*, and 56*c* along the cam groove 41 by a rotation of the cylindrical cam 40 together with the tensile forces of the pressure springs 61*a*, 61*b*, and 61 cause the pressure plates 53*a*, 53*b*, and 53*c* to be sequentially moved in a direction crossing a receiving surface of the receiving tooth part 59 while sliding along the cam groove 41 in adjacent positions. As a result, the pressure tooth parts 55*a*, 55*b*, and 55*c* separated from the receiving tooth part 59 sequentially reach crimping positions that pressurize the receiving tooth part 59 through a sheet bundle ST. That is, every time each of the pressure tooth parts 55*a*, 55*b*, and 55*c* reach the crimping position, the sheet bundle ST is pressurized between each the pressure tooth parts 55*a*, 55*b*, and 55*c* and receiving tooth part 59, whereby the crimp-binding is performed. Thus, the pressure plates 53*a*, 53*b*, and 53*c* constitute a moving part that moves the pressure tooth parts 55*a*, 55*b*, and 55*c*. A drive mechanism including the crimp-binding motor 46, pressure springs 61*a* and 61*c*, and cylindrical cam 40 serve as a drive part that drives the pressure tooth parts 55*a*, 55*b*, and 55*c* such that they are moved to sequentially crimp the sheet bundle ST.

Further, as illustrated in FIG. 9A, a sheet guide pair 86 is swingably supported at its one end by the connection pin 63 of the base plate 52. The sheet guide 86 is swung interlocking with the vertical movements of the pressure plates 53*a*, 53*b*, and 53*c* to adjust the opening degree of the placing part 31 at its entrance side.

That is, as illustrated in FIG. 7B, when the pressure plates 53*a*, 53*b*, and 53*c* are positioned on the upper side, an abutting plate 86A is pressed to an upper side position by the pressure plates 53*a*, 53*b*, and 53*c*, so that the entrance side of the placing part 31 is opened widely to the same size as that of an opening constituted by the table 87 and the clincher mechanism part 88 of the staple-binding unit 81. When a thick sheet bundle ST including a large number of sheets needs to be bound, it is subjected to the staple-binding. In this case, in association with movement of the staple-binding unit 81 for the staple-binding, the crimp-binding unit 82 connected to the staple-binding unit 81 is moved together therewith. Therefore, normally, the opening of the placing part 31 of the crimp-binding unit 82 is opened to the same size as that of the opening of the staple-binding unit 81.

When the pressure plates 53*a*, 53*b*, and 53*c* are moved downward to release the pressing thereof against the sheet guide 86, the sheet guide 86 is suspended by its own weight. As described later, this state is the state immediately before the crimp-binding is started, where the crimp-binding unit 82 waits for conveyance of sheets to be crimp-bound to the placing part 31 with the entrance side of the placing part 31 opened narrow.

According to the thus configured sheet binding device 80, the pressure tooth parts 55*a*, 55*b*, and 55*c*, receiving tooth part 59, and the drive part constituted by the cylindrical cam 40 and crimp-binding motor 46 are disposed at the sides of the pressure plates 53*a*, 53*b*, and 53*c* along the moving direction thereof, whereby space saving can be achieved, which in turn achieves apparatus miniaturization.

[Control Configuration]

Figure 10:
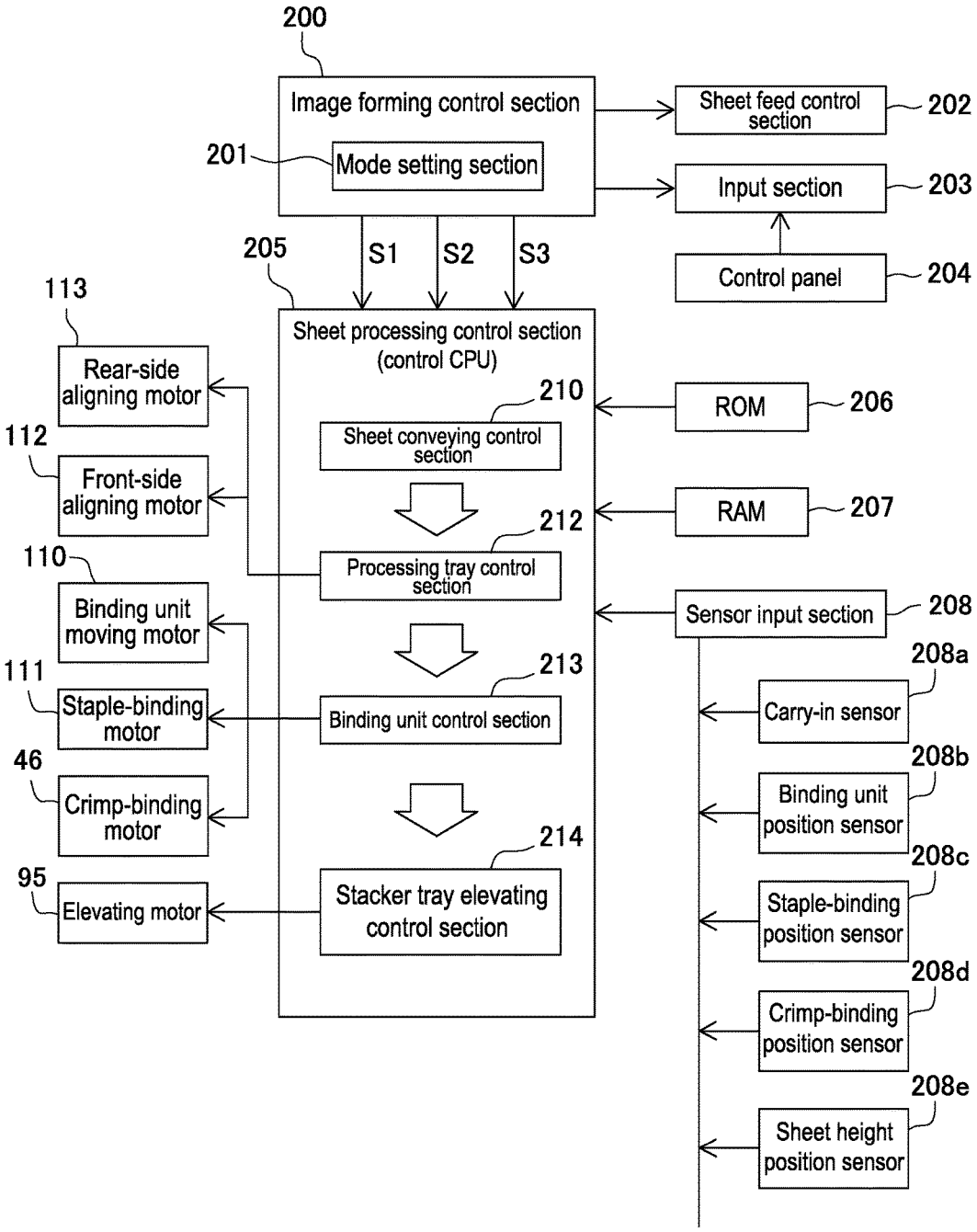
FIG. 10 is a block diagram of the control configuration of the image forming apparatus.

The configuration of a controller 101 of the image forming apparatus will be described referring to FIG. 10. The controller 101 includes an image forming control section 200 that controls an image forming operation in the image forming system A and a sheet processing control section 205 that controls a post-processing operation performed in the sheet processing apparatus B.

The image forming control section 200 includes a mode setting section 201 that sets an image forming mode and a finishing mode. The finishing mode includes a binding processing mode that stacks image-formed sheets in an aligned state and binds them and a printout mode that accommodates the image-formed sheets in the stacker tray 90 without binding them.

An input section 203 having an unillustrated control panel is disposed on the front side of the image forming apparatus. A user of the image forming apparatus inputs (designates) a desired finishing mode, a desired sheet size, and a desired binding mode through the input section 203. After the above setting is made, the image forming control section 200 transmits the setting results to the sheet processing control section 205 in the form of a finishing mode designation signal S1, a sheet size designation signal S2, a binding mode designation signal S3, and the like.

The sheet processing control section 205 controls a post-processing operation performed for image-formed sheets fed from the image forming system A. The sheet processing control section 205 includes a CPU and executes a control program stored in a ROM 206 to realize functions of a sheet conveying control section 210, a processing tray control section 212, a binding unit control section 213, and a stacker tray elevating control section 214, whereby post-processing operation is performed. A RAM 207 stores data required to execute the control program. The sheet processing control section 205 receives detection signals from sensors disposed in various portions of the sheet processing apparatus B through a sensor input section 208.

The sheet conveying control section 210 receives an image-formed sheet from the image forming system A by way of the discharge roller 14 while controlling operations of rollers of each conveying system in the sheet processing apparatus B so that predetermined post-processing is performed according to the contents indicated by the finishing mode designation signal S1, sheet size designation signal S2, and binding mode designation signal S3 output from the image forming control section 200 when a carry-in sensor 208*a* detects conveyance of the image-formed sheet.

The processing tray control section 212 performs rotation control of a front-side aligning motors 112 and a rear-side aligning motor 113 upon execution of the binding processing mode so as to move the aligning plates 84*a* and 84*b* for positioning of a sheet conveyed from the image forming system A in the direction perpendicular to the sheet conveying direction, whereby sheets conveyed to the processing tray 76 are stacked in an aligned state.

The binding unit control section 213 controls a staple-binding or crimp-binding operation according to the size of sheets to be conveyed according to the sheet size designation signal S2 and binding mode designation signal S3. At this time, the binding unit control section 213 controls movement and stop of the binding unit moving motor 110 on the basis of a detection result of a binding unit position sensor 208*b*. Upon execution of the staple-binding, the binding unit control section 213 controls the driving of the staple-binding motor 111 according to a detection signal from a staple-binding position sensor 208*c* so that a sheet bundle ST at a predetermined staple-binding position is subjected to the staple-binding. On the other hand, upon execution of the crimp-binding, the binding unit control section 213 controls the driving of the crimp-binding motor according to a detection signal from a crimp-binding position sensor 208*d* so that a sheet bundle ST at a predetermined crimp-binding position is subjected to the crimp-binding.

The stacker tray elevating control section 214 controls the driving of the elevating motor 95 according to a detection signal from a sheet height position sensor 208*e* so that the height position of sheets placed on the stacker tray 90 is held at a predetermined height position.

[Operation of Crimp-Binding Unit]

In the crimp-binding unit 82, as a result of substantially two rotations of the cylindrical cam 40, the pressure plates 53*a*, 53*b*, and 53*c* are moved downward to cause the pressure tooth parts 55*a*, 55*b*, and 55*c* to sequentially pressurize the receiving tooth part 59 with a sheet bundle ST held therebetween, whereby the crimp-binding is performed. FIGS. 11A to 11E and FIGS. 12A to 12F illustrate trajectories of the cam follower pins 56*a*, 56*b*, and 56*c* that are moved along the helical cam groove 41 formed in the peripheral surface of the cylindrical cam 40 during two rotations of the cylindrical cam 40 and the positional relationship at this time between the receiving tooth part 59 and the pressure tooth parts 55*a*, 55*b*, and 55*c* according to the height positions of the respective pressure plates 53*a*, 53*b*, and 53*c*.

Figure 11A:
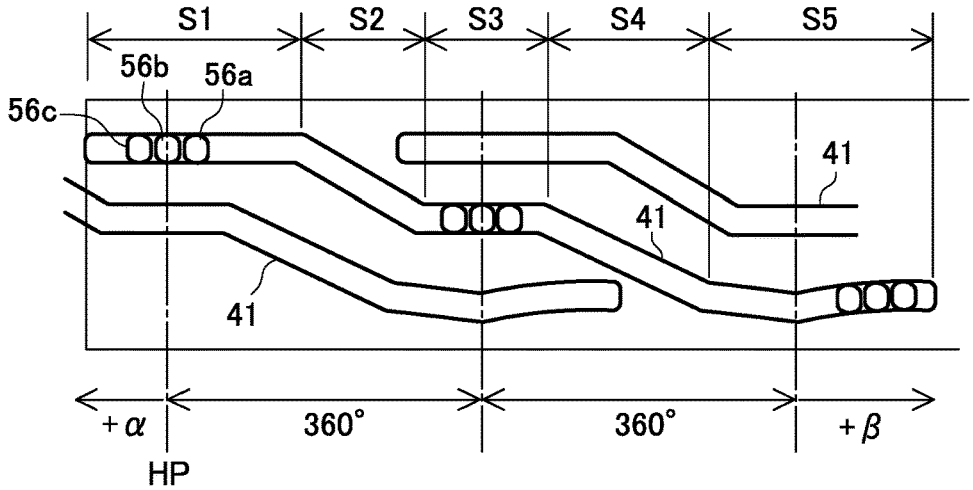
FIG. 11A is a developed view of a cam groove of the cylindrical cam.

As illustrated in FIG. 11A, the cam groove 41 includes, along the peripheral direction of the cylindrical cam 40, a horizontally extending region S1 at the topmost position in the axial line direction of the cylindrical cam 40, a region S2 inclined downward at a substantially fixed angle from the end of the region S1, a horizontally-extending region S3 at the position rotated by substantially 360° from the region S1, a region S4 inclined downward at a substantially fixed angle from the end of the region S3, and the last region S5. As will be described later with reference to FIGS. 12A to 12F, crimp-binding operations of the pressure tooth parts 55*a*, 55*b*, and 55*c* are performed in the region S5.

Figure 11B:
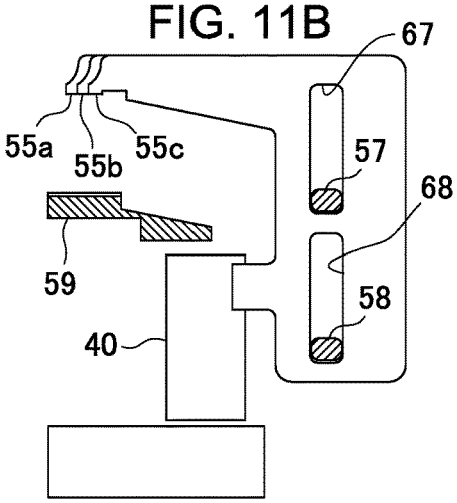
FIGS. 11B, 11C, 11D, and 11E are views each explaining movements of the pressure plates in association with rotation of the cylindrical cam.

The cam follower pins 56*a*, 56*b*, and 56*c* wait at a home position HP in the region S1. FIG. 11B illustrates a state where the slide guides 57 and 58 of the base plate 52 are positioned at the lower ends of the elongated holes 67 and 68 of each of the pressure plates 53*a*, 53*b*, and 53*c*, which corresponds to the state illustrated in FIG. 7B.

In this state, a sheet bundle ST formed by sheets sequentially fed from the image forming section 2 is crimp-bound in the following manner. That is, the binding unit control section 213 of the sheet processing control section 205 controls the binding unit moving motor 110 to move the crimp-binding unit 82 to the crimp-binding position for the sheet bundle ST. Then, the binding unit control section 213 drives the crimp-binding motor 46 to rotate the cylindrical cam 40 in the clockwise direction in the figure. As a result, the cam follower pins 56*a*, 56*b*, and 56*c* are relatively moved along the cam groove 41. While the cam follower pins 56*a*, 56*b*, and 56*c* are engaged with the cam groove 41 in the region S1, the height positions of the pressure plates 53*a*, 53*b*, and 53*c* do not change, and thus the pressure tooth parts 55*a*, 55*b*, and 55*c* are kept in the state illustrated in FIG. 11B.

Figure 11D:
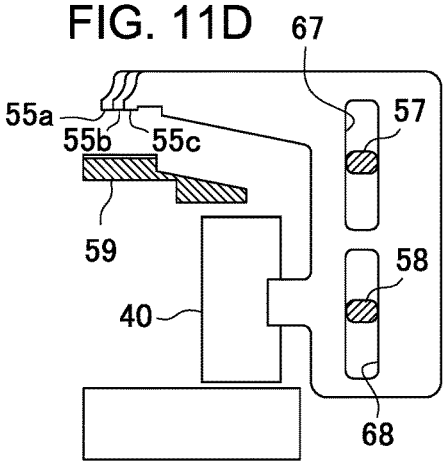
Figure 11C:
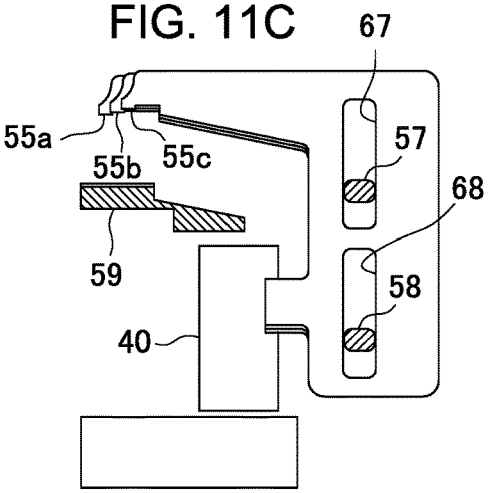
Figure 11E:
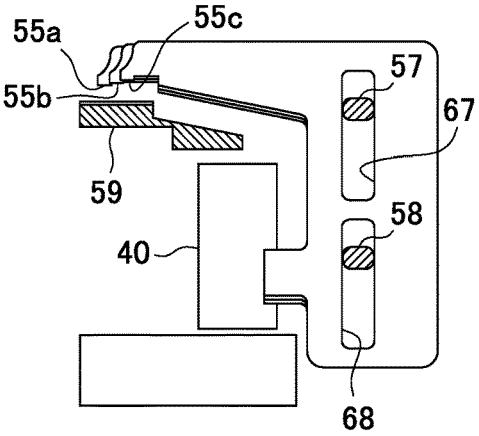

Then, when the cam follower pins 56*a*, 56*b*, and 56*c* are moved from the region S1 of the cam groove 41 to the region S2, the height positions of the cam follower pins 56*a*, 56*b*, and 56*c* are sequentially lowered along the inclination of the region S2. The downward movements of the cam follower pins 56*a*, 56*b*, and 56*c* together with the tensile forces of the pressure springs 61*a*, 61*b*, and 61 cause the pressure plates 53*a*, 53*b*, and 53*c* to be sequentially moved downward while sliding along the cam groove 41 in adjacent positions. FIG. 11C illustrates this state.

When the cylindrical cam 40 is further rotated to make about one rotation from the home position HP, the cam follower pins 56*a*, 56*b*, and 56*c* are moved from the region S2 of the cam groove 41 to the region S3. Since the cam groove 41 extends horizontally in the region S3, the pressure plates 53*a*, 53*b*, and 53*c* are aligned at the half height position of the distance from the receiving tooth part 59 at the initial state, as illustrated in FIG. 11D. In this state, the crimp-binding unit 82 waits for sheets to be conveyed to the placing part 31, and the sheet guide is suspended downward to narrow the entrance of the placing part 31 to thereby guide conveyed sheets.

When all the sheets to be crimp-bound are conveyed to the placing part 31, a second rotation of the cylindrical cam 40 is started, and the sheet bundle ST is crimped by being held between the pressure tooth parts 55*a*, 55*b*, and 55*c* and the receiving tooth part 59. Thus, when the crimp-binding is instructed, the crimp-binding unit 82 immediately rotates the cylindrical cam 40 and waits for sheet conveyance to the placing part 31 during the first rotation. Then, when all the sheets are conveyed, the crimp-binding unit 82 performs the crimp-binding by the second rotation of the cylindrical cam 40. With this procedure, the crimp-binding can be completed in a short time.

At the second rotation, the cam follower pins 56*a*, 56*b*, and 56*c* are moved from the region S3 to the region S4. In the region S4, the groove 41 is inclined again and, as illustrated in 11E, the height positions of the cam follower pins 56*a*, 56*b*, and 56*c* are lowered.

When the cylindrical cam 40 is further rotated to make about two rotations from the home position HP, the cam follower pins 56*a*, 56*b*, and 56*c* are moved from the region S4 of the cam groove 41 to the region S5. In the region S5, the pressure tooth parts 55*a*, 55*b*, and 55*c* sequentially pressurize the receiving tooth part 59 with the sheet bundle ST held therebetween, whereby the sheet bundle ST is crimp-bound.

Figure 12A:
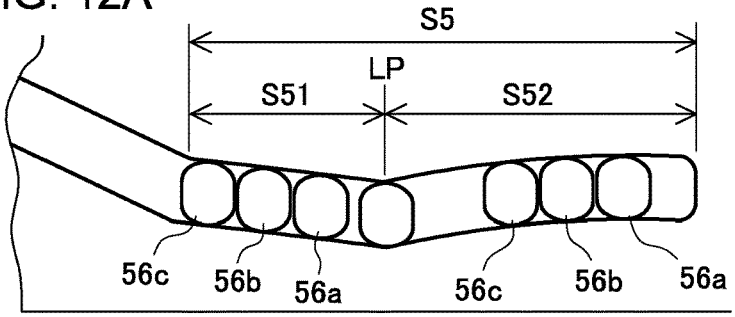
FIGS. 12A to 12F are views continuing from FIG. 11E, explaining operation at crimp-binding.
Figure 12B:
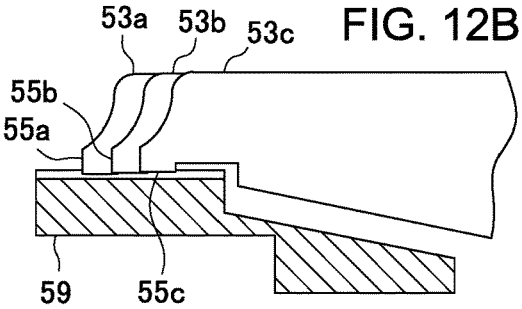

FIGS. 12A to 12F illustrate a crimping operation performed with the cam follower pins 56*a*, 56*b*, and 56*c* engaged with the cam groove 41 in the region S5. As illustrated in FIG. 12A, the region S5 of the cam groove 41 is divided into a region S51 continuous with the region S4 and a region S52 including the lower end portion of the cam groove 41 with the lowermost point LP as a boundary. The region S51 is gently inclined downward, and the height positions of the pressure tooth parts 55*a*, 55*b*, and 55*c* are sequentially gradually lowered toward the lowermost point LP in this order as illustrated in FIG. 12B, followed by meshing with the receiving tooth part 59.

Figure 12C:
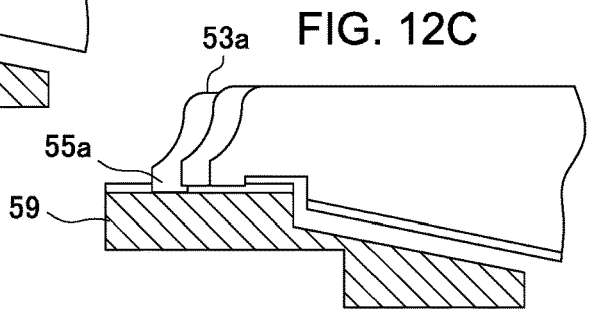
Figure 12D:
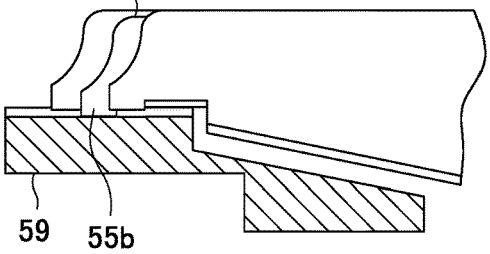
Figure 12E:
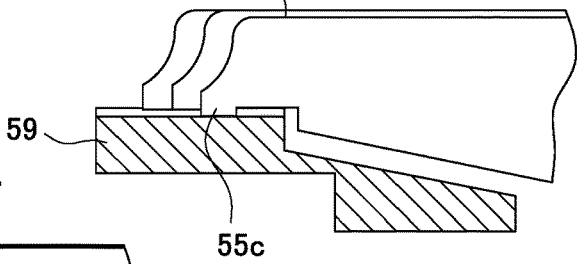

Every time the cam follower pins 56*a*, 56*b*, and 56*c* pass through the lowermost point LP of the cam groove 41 sequentially one by one, the pressure tooth parts 55*a*, 55*b*, and 55*c* are pressed against the receiving tooth part 59 under high pressure, i.e., with a pressurizing force larger than that in the region S51, as illustrated in FIG. 12C to 12E. As described above, the pressure tooth part 55 is divided into three pressure tooth parts, so that a pressurizing area of one pressure tooth part is only ⅓ of the entire pressurizing area. Therefore, the sheet bundle ST can be crimped strongly with a smaller pressurizing load than in a case where the entire pressurizing area is pressurized by one pressure tooth part at a time.

At this time, the tensile forces of the respective pressure springs 61*a*, 61*b*, and 61*c* serve as the pressurizing forces of the respective pressure tooth parts 55*a*, 55*b*, and 55*c* against the receiving tooth part 59. As described above, the pressurizing load required for the pressure tooth parts 55*a*, 55*b* and 55*c* can be made small, so that spring forces of the respective pressure springs 61*a*, 61*b*, and 61*c* can be reduced accordingly, which in turn can reduce the sizes thereof and, eventually, the size of the entire apparatus can be reduced. After pressurization, the pressure tooth parts 55*a*, 55*b*, and 55*c* keep abutting against the receiving tooth part 59 even when the slide guides 57 and 58 are positioned at the uppermost ends of the elongated holes 67 and 68 of each of the pressure plates 53*a*, 53*b*, and 53*c*, so that pressurization can be reliably achieved.

When the pressure tooth parts 55*a*, 55*b*, and 55*c* abut against the receiving tooth part 59 with the sheet bundle ST held therebetween, the wave washer 96 provided between the bearing 43 and the cylindrical cam 40 prevents locking between the cam groove 41 and the cam follower pins 56*a*, 56*b*, and 56*c* due to a thrust load in the axial direction of the cylindrical cam 40 generated by the thickness of the sheet bundle ST by uniformly receiving the thrust load at the circumference thereof.

Figure 12F:
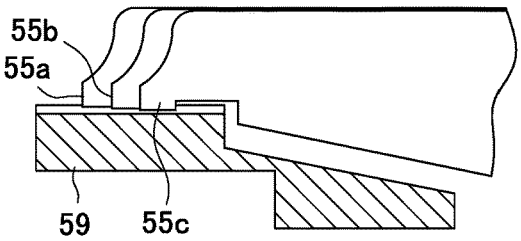
Figure 13:
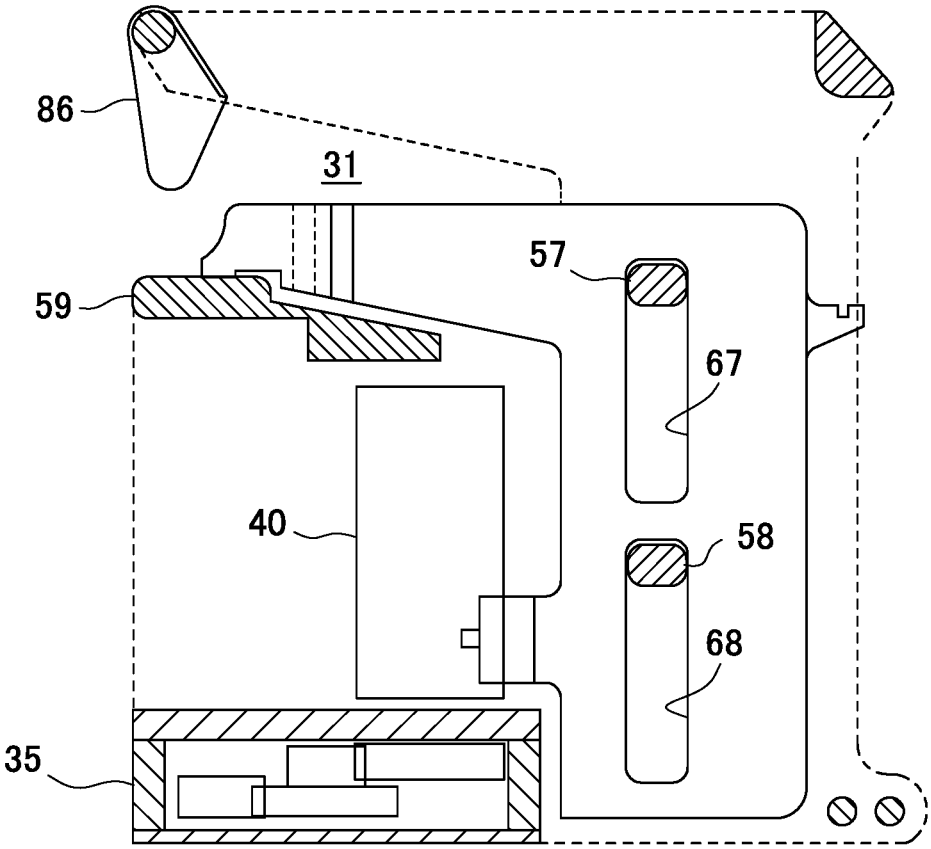
FIG. 13 is a view illustrating a state where pressure tooth parts are positioned at a crimp-binding position where they pressurize a receiving tooth part.

When the cam follower pins 56*a*, 56*b*, and 56*c* pass through the lowermost point LP, a meshing depth between the pressure tooth parts 55*a*, 55*b*, and 55*c* and the receiving tooth part 59 becomes gradually smaller since the region S52 of the cam groove 41 is inclined upward, and the height positions of the pressure tooth parts 55*a*, 55*b*, and 55*c* are sequentially gradually becomes higher in this order as illustrated in FIG. 12F. At this time, as illustrated in FIG. 13, the slide guides 57 and 58 are engaged with the upper and lower two elongated holes 67 and 68, so that the pressure plates 53*a*, 53*b*, and 53*c* are reliably moved upward by the rotation of the cylindrical cam 40 without being rotated by the tensile forces of the respective pressure springs 61*a*, 61*b*, and 61*c*. As illustrated in FIG. 13, when the abutment between the pressure plates 53*a*, 53*b*, and 53*c* and the sheet guide 86 is released, the sheet guide 86 narrows the entrance of the placing part 31 on which the sheet bundle ST is placed to thereby guide carry-in of subsequent sheets.

When the cylindrical cam 40 makes about two rotations in the clockwise direction to complete sequential pressurization of the pressure tooth parts 55*a*, 55*b*, and 55*c* against the receiving tooth part 59, the binding unit control section 213 drives the crimp-binding motor 46 in the reverse direction to return the pressure plates 53*a*, 53*b*, and 53*c* to the home position HP. Accordingly, the cylindrical cam 40 is rotated in the counterclockwise direction in the figure, and the cam follower pins 56*a*, 56*b*, and 56*c* are moved from the region S52 of the cam groove 41 to the region S51. At this time, the cam follower pins 56*a*, 56*b*, and 56*c* sequentially pass through the lowermost point LP again. This time the pressure tooth parts 55*c*, 55*b*, and 55*a* pass through the high pressure position (lowermost point LP) sequentially in this order, and second pressurization against the receiving tooth part 59 is performed with the tensile forces of the respective pressure springs 61*a*, 61*b*, and 61*c*.

Then, the cylindrical cam 40 makes about two rotations in the counterclockwise direction, and the cam follower pins 56*a*, 56*b*, and 56*c* are moved along the cam groove 41 in the reverse direction to the home position HP. Along with this movement, the slide guides 57 and 58 of the base plate are moved relative to the elongated holes 67 and 67, respectively, from the upper end to the lower end, so that the pressure plates 53*a*, 53*b*, and 53*c* are moved in the vertical direction by the tensile forces of the respective pressure springs 61*a*, 61*b*, and 61*c*. Thus, a cam mechanism realized by engagement between the cam groove 41 of the cylindrical cam 40 and the cam follower pins 56*a*, 56*b*, and 56*c* can utilize the tensile forces of the respective pressure springs 61*a*, 61*b*, and 61*c* for crimp-binding of the sheet bundle ST only at the pressurizing time.

Figure 14:
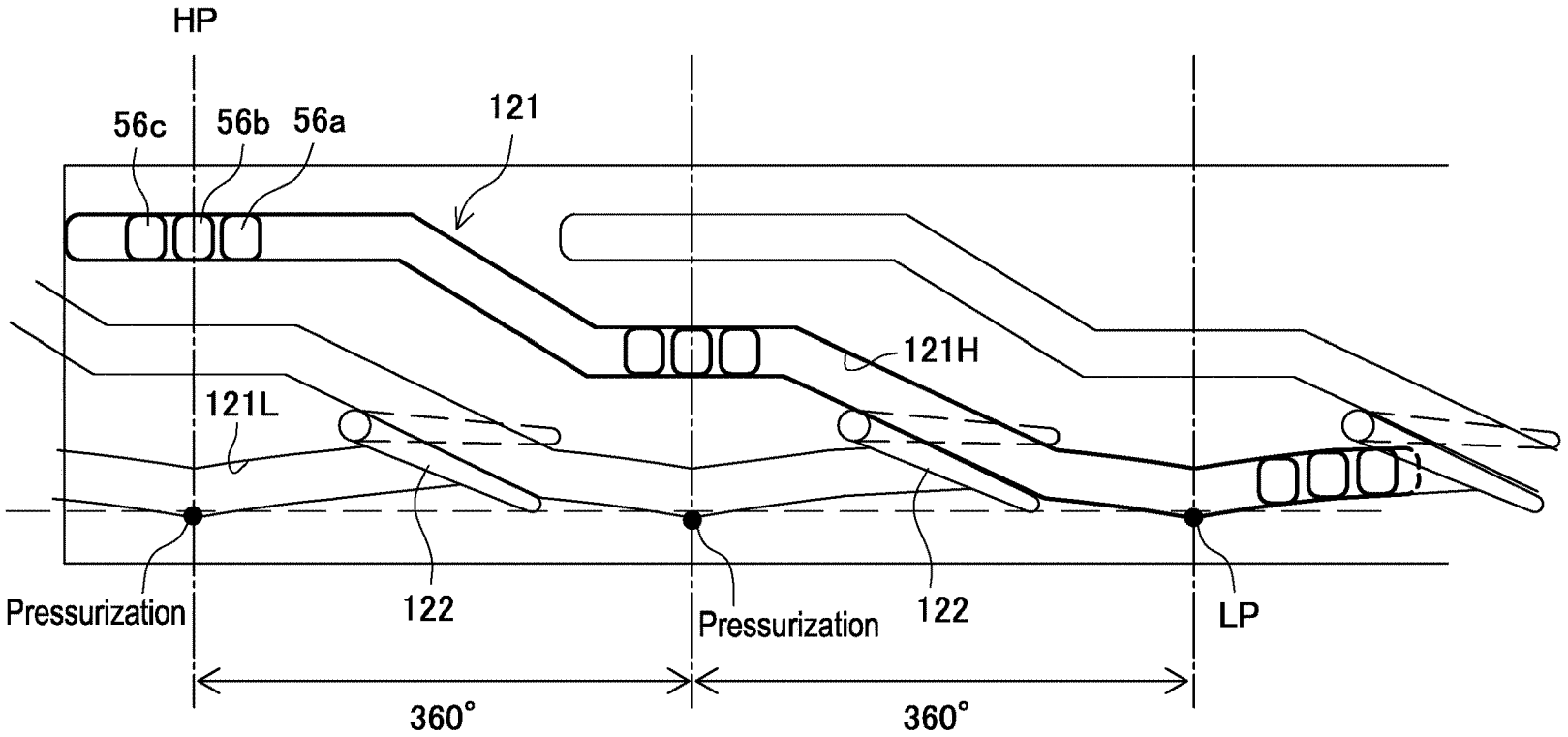
FIG. 14 illustrates a modification of the cam groove of FIGS. 11A to 11E.

FIG. 14 illustrates a modification of the cam groove 41 formed in the cylindrical cam 40. A cam groove 121 of the present modification extends in the same manner as the cam groove 41 until it reaches the lowermost point LP and, in an area subsequent to the lowermost point LP, a groove part 121L having a shape meandering up and down in the same height position of the cam peripheral surface is continuously formed. In this configuration, a gate 122 opened/closed in one direction is provided at a position where the groove part 121L meandering by rotation of the cylindrical cam 40 crosses a groove part 121H leading to the groove part 121L positioned thereabove so as to allow the cam follower pins 56*a*, 56*b*, and 56*c* to be moved in only the direction along the rotation of the cylindrical cam 40.

When the cylindrical cam 40 having thus configured cam groove 121 is rotated, the cam follower pins 56*a*, 56*b*, and 56*c* at the home position HP are moved downward along the cam groove 121 as in the case of the cam groove 41. However, when reaching the groove part 121L, the cam follower pins 56*a*, 56*b*, and 56*c* are moved in the horizontal direction along the shape of the groove part 121L while meandering. Thus, every time the cam follower pins 56*a*, 56*b*, and 56*c* pass through the valley of the meandering part, the pressure tooth parts 55*a*, 55*b*, and 55*c* sequentially pressurize the receiving tooth part 59 by the tensile forces of the pressure springs 61*a*, 61*b*, and 61*c*. That is, the cam follower pins 56*a*, 56*b*, and 56*c* pressurize the receiving tooth part 59 a plurality of times.

When reaching the gate 122 along the groove part 121L, the cam follower pins 56*a*, 56*b*, and 56*c* return to the head position of the groove part 121L by pushing away the gate 122. Thereafter, while the cylindrical cam 40 continues rotating, the cam follower pins 56*a*, 56*b*, and 56*c* continue advancing along the groove 121L, and pressure tooth parts 55*a*, 55*b*, and 55*c* perform pressurization every time they reach the valley of the meandering part. That is, the groove 121L has such a shape as to allow the pressure tooth parts

55*a*, 55*b*, and 55*c* to be moved between the separating position and the crimping position in a repetitive manner, whereby the sheet bundle ST is pressurized plurality of times. As a result, the sheet bundle ST is strongly crimp-bound.

Subsequently, when the cylindrical cam 40 is rotated in the reverse direction, the cam follower pins 56*a*, 56*b*, and 56*c* are moved along the groove part 121L in the reverse direction. When reaching the head position of the groove part 121L, the cam follower pins 56*a*, 56*b*, and 56*c* are guided to the groove part 121H by the gate 122 and then moved along the cam groove 121 in the reverse direction to reach the home position HP. While the cam follower pins 56*a*, 56*b*, and 56*c* are moved along the groove part 121L of the cam groove 121 by the reverse rotation of the cylindrical cam 40, the receiving tooth part 59 is pressurized by the cam follower pins 56*a*, 56*b*, and 56*c* every time the cam follower pins 56*a*, 56*b*, and 56*c* pass through the valley of the meandering part.

Figure 15:
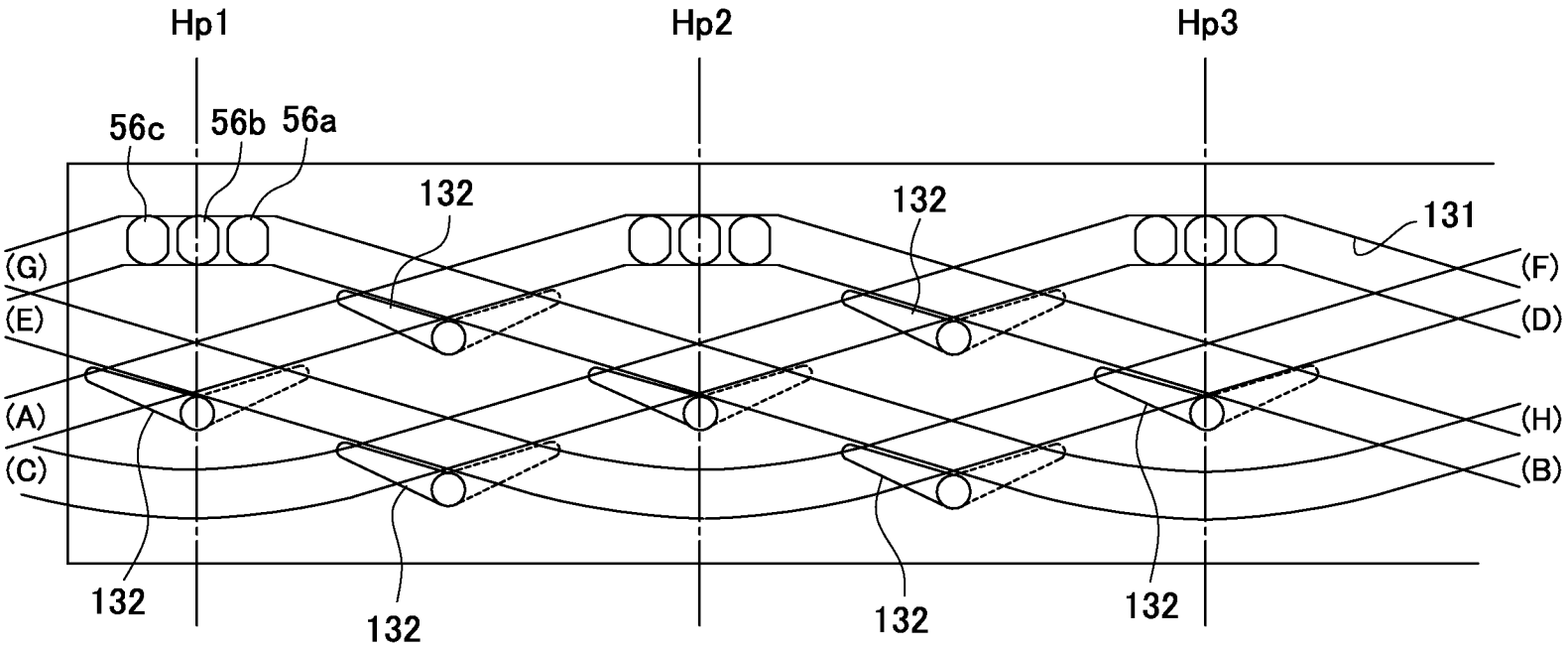
FIG. 15 is a view illustrating another embodiment of the cam groove.

FIG. 15 illustrates another embodiment of the cam groove. That is, a helical cam groove 131 is formed on the circumferential surface of the cylindrical cam 40 so as to extend from the upper side to the lower side and from the lower side to the upper side in an endlessly repeated manner. In this configuration, the cam groove 131 is formed as a closed loop extending as illustrated in FIG. 15 ((A)-(B)-(C)-(D)-(E)-(F)-(G)-(H)-(A)). Thus, even when the cylindrical cam 40 is rotated normally and reversely to change its rotation direction, the trajectories of the cam follower pins 56*a*, 56*b*, and 56*c* are the same. Therefore, there are provided a gate 132 for switching the moving direction of the cam follower pins 56*a*, 56*b*, and 56*c* to two directions at groove crossing positions.

According to the thus configured cam groove 131, even when the crimp-binding motor 46 is rotated in one direction (CW), the pressure plates 53*a*, 53*b*, and 53*c* are positioned at the home position HP when the cam follower pins 56*a*, 56*b*, and 56*c* are positioned at the ridge part of the topmost position of the cylindrical cam 40, and the pressure plates 53*a*, 53*b*, and 53*c* are moved downward to cause the pressure tooth parts 55*a*, 55*b*, and 55*c* to sequentially pressurize the receiving tooth part 59 when the cam follower pins 56*a*, 56*b*, and 56*c* are positioned at the valley part of the topmost position of the cylindrical cam 40. In this case, when the gate 132 is closed, the cam follower pins 56*a*, 56*b*, and 56*c* being moved along the cam groove 131 push away the gate 132. Thus, by rotation of the crimp-binding motor 46 in one direction, the pressure tooth parts 55*a*, 55*b*, and 55*c* are moved between the crimping position and the separating position to crimp the sheet bundle ST in a repetitive manner. As a matter of course, when the gate is disposed at the position denoted by the dashed line, the same operation as above is performed even at the reverse rotation (CCW) of the crimp-binding motor 46.

In the thus described crimp-binding unit 82, the crimp-binding motor 46 and cylindrical cam 40 are incorporated in the space between the crimp-binding part base 35 and the receiving tooth part 59 so as to be supported by the receiving tooth part 59 and are thereby disposed vertically along the moving direction of the pressure tooth parts 55*a*, 55*b*, and 55*c*. In addition, the pressure plates 53*a*, 53*b*, and 53*c* of the moving part are disposed such that the cam follower pins 56*a*, 56*b*, and 56*c* are engaged with the cam groove 41 formed in the side portion of the cylindrical cam 40 and, accordingly, the pressure tooth parts 55*a*, 55*b*, and 55*c*, receiving tooth part 59, and the drive part constituted by the cylindrical cam 40 and crimp-binding motor 46 are disposed at the sides of the pressure plates 53*a*, 53*b*, and 53*c*, whereby the space in the apparatus can be effectively utilized, which in turn achieves apparatus miniaturization.

The following describes effects of the apparatus disclosed hereinbefore. To attain the first object, the pressure tooth part is divided in the direction crossing the pressurizing direction into the pressure tooth parts 55*a*, 55*b*, and 55*c*, and the pressure tooth parts 55*a*, 55*b*, and 55*c* are sequentially pressurized against the receiving tooth part 59. With this configuration, a load per pressurizing unit area is significantly reduced, whereby the sheet processing apparatus can be made small in size and low in cost.

The pressurizing range of the pressure tooth part 55 (pressure tooth parts 55*a*, 55*b*, and 55*c*) is preferably made smaller than the size of the receiving surface of the receiving tooth part 59. Specifically, by setting the pressurizing range of each divided part of the pressure tooth part 55 to about ½ to ¼ of the width and length of the receiving surface of the receiving tooth part 59 depending on the number of the pressure tooth parts, that is, by dividing the pressure tooth part 55 into two to four parts, effective crimping can be achieved. Further, by disposing the pressure tooth parts 55*a*, 55*b*, and 55*c* such that a step-like crimping surface (crimping mark) is formed on the sheet bundle, oblique crimping can be done without the need for inclining the device (crimp-binding unit 82).

The moving part that moves the pressure tooth parts 55*a*, 55*b*, and 55*c* is formed by the plate-like pressure plates 53*a*, 53*b*, and 53*c*. That is, the pressure plates 53*a*, 53*b*, and 53*c* each have the pressure tooth part 55 at its leading end and slide along the cam groove 41 in adjacent positions. With this configuration, the space for movement of the pressure tooth part falls within the slide movement range of the pressure plates 53*a*, 53*b*, and 53*c*, making it possible to further reduce the apparatus size.

Further, the sheet guide 86 that guides a sheet bundle ST to be carried in is swingably disposed on both sides of the pressure tooth part 55. This allows sheets to be bound to be carried in smoothly.

Further, in the disclosed apparatus, the pressure tooth parts 55*a*, 55*b*, and 55*c* are reciprocated in the vertical direction with respect to the receiving surface of the receiving tooth part 59. With this configuration, the pressure tooth part is not rotated as in the conventional case but moved substantially vertically, so that the concavo-convex surfaces of the respective pressure tooth parts 55*a*, 55*b*, and 55*c* and the concavo-convex surface of the receiving tooth part 59 can accurately mesh with each other. Accordingly, the pressure tooth parts 55*a*, 55*b*, and 55*c* pressurize the receiving surface of the receiving tooth part 59 uniformly, so that uneven pressurization does not occur in the crimping of a sheet bundle ST, allowing the crimp-binding to be effectively performed.

At this time, the moving part that moves the pressure tooth parts 55*a*, 55*b*, and 55*c* is formed by the plate-like pressure plates 53*a*, 53*b*, and 53*c* that support the respective pressure tooth parts 55*a*, 55*b*, and 55*c*. This achieves a reduction in the thickness of the moving part.

The pressure tooth part is preferably divided into a plurality of parts to divide the pressurizing range, and the pressure plates 53*a*, 53*b*, and 53*c* that support the respective pressure tooth parts are preferably configured to be movable in the vertical direction while sliding in adjacent positions.

The plurality of pressure tooth parts 55*a*, 55*b*, and 55*c* pressurize the receiving tooth part 59 at different positions. Accordingly, the crimping mark is formed at different positions, allowing reliable crimping of a sheet bundle.

Further, the drive part includes the crimp-binding motor (drive motor) 46 and the cylindrical cam 40, and one ends of the pressure plates 53*a*, 53*b*, and 53*c* as the moving part are engaged with the cam groove 41 formed in the cylindrical cam 40. With this configuration, the pressure plates 53*a*, 53*b*, and 53*c* are moved in a substantially vertical direction by rotation of the cylindrical cam 40.

The crimp-binding motor 46 moves the pressure tooth parts 55*a*, 55*b*, and 55*c* supported by the respective pressure plates 53*a*, 53*b*, and 53*c* from the crimping position to the separating position by normal rotation thereof and moves them from the separating position to the crimping position by reverse rotation thereof. The cam groove 41 is preferably formed into such a shape as to allow the pressure tooth parts 55*a*, 55*b*, and 55*c* to pressurize a sheet bundle ST a plurality of times by normal rotation of the crimp-binding motor 46, which achieves more reliable crimp-binding.

Alternatively, the cam groove 41 of the cylindrical cam 40 may be formed into such a shape as to allow the pressure tooth parts 55*a*, 55*b*, and 55*c* to be moved in a repetitive manner between the crimping position and the separating position by continuous rotation of the crimp-binding motor 46 in one direction.

To attain the second object, the pressure tooth parts 55*a*, 55*b*, and 55*c*, receiving tooth part 59, crimp-binding motor (drive part) 46, and cylindrical cam (drive part) 40 are disposed along the moving direction of the pressure plates (moving part) 53*a*, 53*b*, and 53*c* that moves the pressure tooth parts 55*a*, 55*b*, and 55*c* to the receiving tooth part 59, and the pressure plates (drive part) 53*a*, 53*b*, and 53*c* are disposed at the side of the drive part.

Thus, the receiving tooth part 59 and crimp-binding motor (drive part) 46 are disposed along the moving direction of the pressure tooth parts 55*a*, 55*b*, and 55*c* in an overlapping manner, so that space saving can be achieved, whereby the sheet processing apparatus can be made small in size and low in cost.

The pressurizing range of the pressure tooth part (pressure tooth parts 55*a*, 55*b*, and 55*c*) is divided. The moving part is constituted of plate-like pressure plates 53*a*, 53*b*, and 53*c* that support the pressure tooth parts 55*a*, 55*b*, and 55*c*. The drive part is constituted of the crimp-binding motor 46 and the cylindrical cam 40 and is engaged with the cylindrical cam 40 at the base end sides of the pressure plates 53*a*, 53*b*, and 53*c* to sequentially pressurize the receiving tooth part 59. With this configuration, the pressure plates 53*a*, 53*b*, and 53*c* are moved in the surface direction, and thus the space where the pressure plates 53*a*, 53*b*, and 53*c* are moved can be reduced.

In this case, the pressure tooth parts 55*a*, 55*b*, and 55*c* and their base end portions are formed into a sickle shape in the pressure plates 53*a*, 53*b*, and 53*c*, respectively. This allows a pressurizing force to be effectively transmitted from the pressure plate to the pressure tooth part. Further, the pressure plate has the slide guide part (elongated holes 67 and 68) that moves the pressure tooth part to the receiving tooth part vertically, allowing a pressurizing force to be effectively applied to the receiving tooth part 59.

The cam is constituted as the cylindrical cam 40, and the receiving tooth part 59 is disposed so as to support one end sides of the respective crimp-binding motor 46 and cylindrical cam 40 at the surface thereof opposite to the receiving surface. Thus, the pressure tooth part, the pressure plate provided with the pressure tooth part, the receiving tooth part, and the drive part are disposed with high integration, making it possible to further reduce the size of the sheet processing apparatus.

The crimp-binding motor 46 can be rotated both normally and reversely, and moves the pressure tooth parts 55*a*, 55*b*, and 55*c* supported by the respective pressure plates 53*a*, 53*b*, and 53*c* from the separating position to the crimping position or from the crimping position to the separating position according to its rotation direction. Further, there are provided the pressure springs 61*a*, 61*b*, and 61*c* (elastic members) that bias the pressure tooth parts 55*a*, 55*b*, and 55*c* toward the receiving tooth part 59. Thus, the pressure tooth parts 55*a*, 55*b*, and 55*c* are pressurized against the receiving tooth part 59 by the biasing forces of the pressure springs 61*a*, 61*b*, and 61*c*, so that a sheet bundle ST can be crimped strongly.

In the description of the embodiment and the effects thereof, reference numerals are given to principle constituent elements recited in the claims so as to clarify a correspondence relationship between the description of "Detailed Description" and the description of "What is Claimed is". Further, it should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements from the content disclosed in the specification by a person skilled in the art, which are included in the technical scope defined by the appended claims.

This application is based upon and claims the benefit of priority from prior Japanese Patent Applications No. 2016-092732 filed May 2, 2016, No. 2016-092733 filed on the same date, and No. 2016-092734 filed on the same date, the entire contents of which are incorporated herein by reference.

What is claimed is:

1. A sheet processing apparatus that crimp-binds a sheet bundle by pressurizing the sheet bundle from front and back sides of the sheet bundle, comprising:

a pressure tooth part that has a concave-convex surface and pressurizes a range of one binding portion in the sheet bundle, the pressure tooth part being divided such that the range of the one binding portion is divided in a direction crossing a pressurizing direction to sequentially pressurize divided portions;

a receiving tooth part that is disposed opposite to the pressure tooth part and receives pressurization from the pressure tooth part with the sheet bundle held therebetween for crimping of the sheet bundle;

a moving part that reciprocates each of divided ranges of the pressure tooth part with respect to a receiving surface of the receiving tooth part; and a drive part that drives the moving part that moves the pressure tooth part for crimping of the sheet bundle.

2. The sheet processing apparatus according to claim 1, wherein each of the divided ranges of the pressure tooth part has a pressurizing range smaller than the receiving surface.

3. The sheet processing apparatus according to claim 2, wherein a plurality of moving parts is provided corresponding to the pressure tooth part, each of the plurality of moving parts having a plate shape, and is contacted to slid, and each of the divided ranges of the pressure tooth part is provided at a leading end of each of the plurality of moving parts.

4. The sheet processing apparatus according to claim 1, wherein the pressure tooth part is disposed such that the divided ranges are disposed at positions different from each other in a conveying direction of the sheet bundle to form a step shape.

5. The sheet processing apparatus according to claim 1, wherein the moving part reciprocates the pressure tooth part with respect to the receiving surface of the receiving tooth part in a vertical direction, and the drive part drives the moving part so that the pressure tooth part is moved between a crimping position where the pressure tooth part crimps the sheet bundle and a separating position separated from the crimping position.

6. The sheet processing apparatus according to claim 5, wherein a plurality of the moving parts is pressure plates that support the pressure tooth part.

7. The sheet processing apparatus according to claim 6, wherein the pressure tooth part is provided to divide a pressurizing range with respect to the receiving tooth part, and the pressure plates that support the pressure tooth part are slidable in adjacent positions and movable in the vertical direction.

8. The sheet processing apparatus according to claim 7, wherein the pressure tooth part pressurizes the receiving tooth part at different positions.

9. The sheet processing apparatus according to claim 7, wherein the drive part is constituted of a drive motor and a cylindrical cam, and the pressure plate has one end engaged with a cam groove formed in the cylindrical cam.

10. The sheet processing apparatus according to claim 9, wherein the drive motor is rotatable both normally and reversely, and the pressure tooth part supported by the pressure plate is moved from the separating position to the crimping position or from the crimping position to the separating position according to a rotation direction of the drive motor.

11. The sheet processing apparatus according to claim 9, wherein the cam groove has such a shape as to allow the pressure tooth part to pressurize the sheet bundle a plurality of times.

12. The sheet processing apparatus according to claim 9, wherein the cam groove of the cylindrical cam is formed into such a shape as to allow the pressure tooth part to be moved between the crimping position and the separating position by rotation of the drive motor in one direction.

13. The sheet processing apparatus according to claim 1, further comprising a binding unit moving part moving the pressure tooth part and the receiving tooth part along one side of a sheet bundle, wherein all of the divided ranges divided from the pressure tooth part crimp-bind the sheet bundle at staple-binding positions located different from each other along the one side of the sheet.

14. A sheet processing apparatus that crimp-binds a sheet bundle by pressurizing the sheet bundle from front and back sides of the sheet bundle, comprising:

a plurality of pressure tooth parts that has a concave-convex surface to pressurize a predetermined crimp-binding range of the sheet bundle and sequentially pressurizes the predetermined crimp-binding range in a direction crossing a pressurizing direction;

a receiving tooth part that has a concave-convex surface to pressurize the predetermined crimp-binding range of the sheet bundle and is disposed opposite to the plurality of pressure tooth parts so as to receive pressure from the plurality of pressure tooth parts;

a drive part moving the plurality of pressure tooth parts and the receiving tooth part such that a distance between each of the plurality of pressure tooth parts and the receiving tooth part is reduced to crimp-bind each other;

a moving part moving the plurality of pressure tooth parts and the receiving tooth part, along one side of the sheet bundle, to binding positions in which a binding process is performed; and a control unit controlling the drive part and the moving part, wherein the control unit controls the plurality of pressure tooth parts to sequentially pressurize divided portions in which the predetermined crimp-binding range is divided in the direction crossing the pressurizing direction of the plurality of pressure tooth parts, at the binding positions.

* * * * *